US007744985B2

(12) United States Patent
Tamagawa et al.

(10) Patent No.: US 7,744,985 B2
(45) Date of Patent: Jun. 29, 2010

(54) IMAGE-RECORDING MATERIAL SUPPORT, METHOD FOR PRODUCING THE SAME, AND IMAGE RECORDING MATERIAL

(75) Inventors: Shigehisa Tamagawa, Shizuoka (JP); Yutaka Kubota, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 802 days.

(21) Appl. No.: 11/633,463

(22) Filed: Dec. 5, 2006

(65) Prior Publication Data

US 2007/0134448 A1 Jun. 14, 2007

(30) Foreign Application Priority Data

Dec. 6, 2005 (JP) ..... 2005-352411

(51) Int. Cl.
*B41M 5/00* (2006.01)
*B41M 5/41* (2006.01)
*B41M 5/50* (2006.01)

(52) U.S. Cl. ..... 428/211.1; 428/32.21; 428/32.63; 503/200; 503/227

(58) Field of Classification Search ..... None
See application file for complete search history.

(56) References Cited

U.S. PATENT DOCUMENTS

| | | | | |
|---|---|---|---|---|
| 5,151,404 | A * | 9/1992 | Suzuki et al. | 503/200 |
| 6,777,101 | B2 | 8/2004 | Kegasawa et al. | |
| 7,160,602 | B2 * | 1/2007 | Tamagawa | 428/195.1 |

FOREIGN PATENT DOCUMENTS

| | | |
|---|---|---|
| JP | 2003-076052 | 3/2003 |
| JP | 2003-177565 | 6/2003 |

* cited by examiner

*Primary Examiner*—Bruce H Hess
(74) *Attorney, Agent, or Firm*—Sughrue Mion, PLLC

(57) ABSTRACT

The present invention provides an image recording material support which contains a paper, wherein the paper contains at least a pulp; and the content ratio of long fiber pulp having a fiber length of 0.7 mm or more in the paper relative to the entire pulp content is 20% or less; and also provides a method for producing an image recording material support which includes beating a pulp using a refiner equipped with beating plates having an average blade angle of 10 degrees or less.

12 Claims, 3 Drawing Sheets

IMAGE-RECORDING MATERIAL SUPPORT, METHOD FOR PRODUCING THE SAME, AND IMAGE RECORDING MATERIAL

BACKGROUND OF THE INVENTION

1. Field of the Invention

The present invention relates to an image recording material support which is preferably used for electrophotographic materials, heat sensitive materials, sublimation transfer materials, heat transfer materials, silver slat photographic materials, inkjet-recording materials, and the like. The present invention also relates to a method for producing the image recording material support, and an image recording material using the image recording material support.

2. Description of the Related Art

Typically, paper, synthetic paper, synthetic resin sheet, coat paper, laminate paper, and the like are well known as supports for various image-recording materials such as electrophotographic materials, heat sensitive materials, inkjet-recording materials, sublimation transfer materials, silver salt photographic materials, and heat transfer materials. Among the above-noted image recording material supports, laminate paper having a coated layer made of polyolefin resin or the like on a surface thereof is preferably used in order to obtain an image print having high-quality, high-glossiness, high planality, and the like (Japanese Patent Application Laid-Open (JP-A) Nos. 2003-76052 and 2003-177565).

In recent years, high-quality image printing of full-color images, photographic images, or the like has become performed more frequently, and it has been desired to provide an image recording material which allows obtaining an image print having higher image quality, higher glossiness, and higher planality. In association with this trend, improvements in further planality and glossiness are required for image recording material supports, and to ensure steady rigidity is more desired. However, an image recording material support capable of adequately satisfying all the performances has not been provided yet.

SUMMARY OF THE INVENTION

The present invention aims to provide an image recording material support which has excellent planality and glossiness and is excellent and steady in rigidity, a method for producing the image recording material support, and an image recording material using the image recording material support.

The image recording material support of the present invention contains paper containing at least pulp, and in the paper, the content ratio of long fiber pulp having a fiber length of 0.7 mm or more relative to the entire content of pulp is 20% or less. As the result, an image recording material support which is steady and excellent in rigidity can be obtained.

The method for producing an image recording material support of the present invention includes beating pulp using a refiner which is provided with a beating plate of which the average blade angle is 10 degrees or less. In the method for producing an image recording material support of the present invention, the content ratio of long fiber pulp having a fiber length of 0.7 mm or more relative to the entire content of pulp is 20% or less, has excellent planality, glossiness, and steady rigidity and allows efficiently producing an image recording material support of the present invention.

The image recording material of the present invention has the image recording material support of the present invention, and therefore, it allows forming a full-color high-quality image print which is high-quality and has high-glossiness and high-planality.

DESCRIPTION OF THE PREFERRED EMBODIMENTS

Image Recording Material Support

Figure 1A:
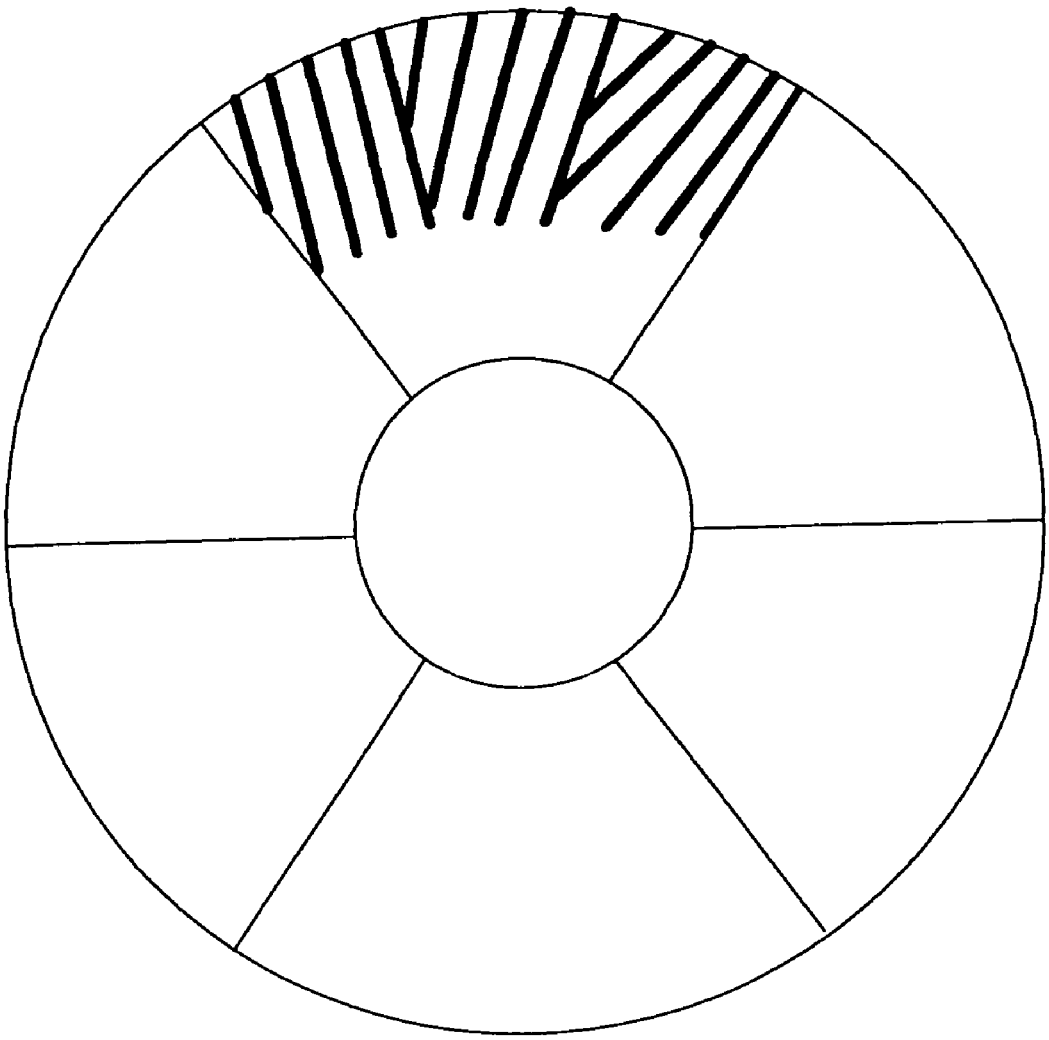
FIG. 1A is a view exemplarily illustrating the average blade angle of a beating plate.

The image recording material support of the present invention contains paper containing at least pulp, a polymer coat layer and further contains other layers in accordance with the necessity.

—Paper—

The above-noted paper contains at least pulp, and the content ratio of long fiber pulp having a fiber length of 0.7 mm or more in the paper relative to the entire content of pulp is 20% or less, and more preferably 15% or less. The lower limit thereof is not particularly limited and may be suitably selected in accordance with the intended use. However, it is preferably 5%. When the content ratio of the long fiber pulp is more than 20%, the texture of paper may be degraded to thereby cause reductions in planality.

The average fiber length of the pulp is preferably 0.6 mm to 0.7 mm. When the average fiber length is less than 0.6 mm, the rigidity of the paper may be degraded. When the average fiber length is more than 0.7 mm, the planality of the paper may be degraded, and the cut edge shape of the paper may be degraded.

Here, the fiber length of the pulp can be measured as stated below.

First, a paper matrix of a 4 cm×4 cm image recording material support is soaked in 80 $cm^3$ of a sodium hydroxide aqueous solution defined as 1.0 for 3 days and then the paper is sufficiently washed with water. Next, pure water is added to the adequately washed paper matrix with water so as to be a slurry of 3% by mass pure water, and the paper matrix is defiberized using a dispersing unit so as not to cut off pulp fibers to thereby obtain a pulp slurry. The obtained pulp slurry is measured as to the length-weighted average fiber length in conformity to the JAPAN TAPPI Paper Pulp Testing Method No. 52-89 of "Testing method for length of paper and pulp fibers. The measured length-weighted average fiber length (mm) is taken as the average fiber length of the pulp.

The dispersing unit is not particularly limited and may be suitably selected in accordance with the intended use, provided that the pulp fibers can be defiberized without cutting off the pulp fibers. For example, a juicer mixer having rounded blades configured not to cut off fibers can be used, and pulp fibers are stirred for 20 minutes, thereby the pulp fiber can be defiberized.

The pulp usable as a raw material of the paper is preferred to be the broad-leaf tree pulp, from the viewpoint of simultaneously improving planarity, dimension stability and the like of the paper, in a good balance and to a sufficient level. The needle-leaf tree pulp, synthetic pulp, mixed pulp thereof is, however, also usable.

Examples of the broad-leaf tree pulps include broad-leaf tree bleached kraft pulp (LBKP), and broad-leaf tree sulfite pulp (LBSP). Among these, the broad-leaf tree bleached kraft pulp (LBKP) is preferable.

The content of the broad-leaf tree pulp relative to the paper is not particularly limited, and can be suitably selected in accordance with the intended use. For example, the content is preferred to be 50% by mass or more, more preferably 60% by mass or more, and still more preferably 75% by mass or more.

Examples of the needle-leaf tree pulp include needle-leaf tree bleached kraft pulp (NBKP).

Beating of the pulp is preferably performed by the use of a refiner which is provided with a beating plate (disk) having the average blade angle of 10 degrees or less. The average blade angle is 10 degrees or less, and preferably 0 degrees to 8 degrees. When the average blade angle is greater than 10 degrees, it may be difficult to reduce the content ratio of long finer pulp to a target value.

The beating plate is formed in the form of a ring in contact with a plurality of beating plate parts. For example, six beating plate parts are arrayed at each 60 degrees to constitute one plate surface (360 degrees).

The beating plate part is provided with a plurality of blades and grooves which are formed in a radial pattern in the radius direction relative to the center portion of the ring.

The blade angle formed with a radius line in the case where blades are radially arrayed from the center portion is zero degrees. Each of blade angles formed with radius lines is determined, and the average value of the blade angles is defined as the average blade angle.

Figure 1B:
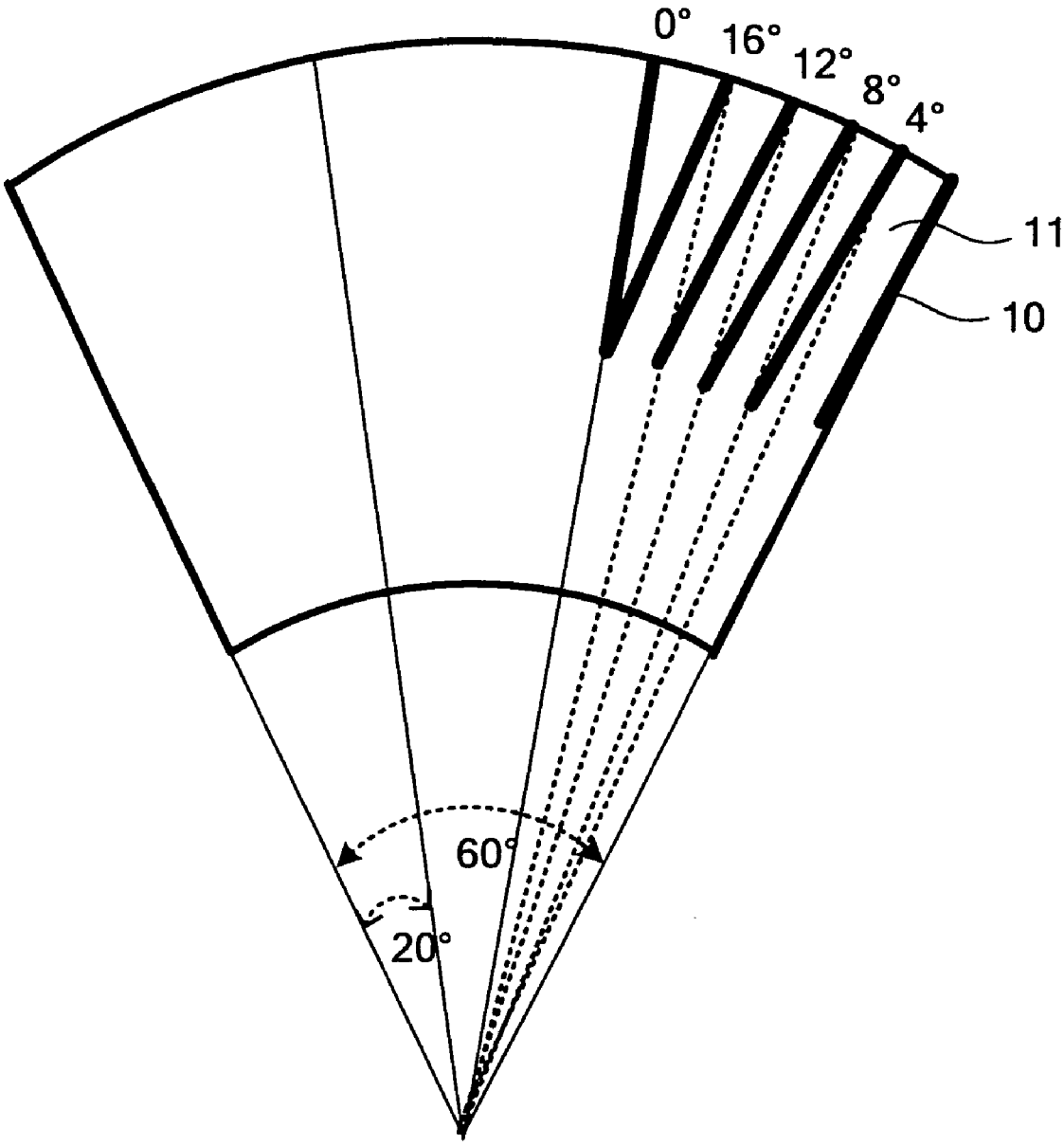
FIG. 1B is a partially enlarged view of FIG. 1A.

As for the average blade angle, in examples shown in FIGS. 1A and 1B, for example, one beating plate part is formed with three blades each of which is in a repeated pattern arranged at each 20 degrees of the average blade angle. In one beating plate, four blades 10 are arrayed in parallel with a first blade disposed at zero degrees so as to sandwich grooves to the next blade disposed at zero degrees. In this case, a blade angle is increased by 4 degrees increments, and thus the average blade angle is eight degrees (0°+4°+8°+12°+16°)/5.

Six plate parts each being a fan-shaped beating plate part shown in FIG. 1B are combined to constitute one beating plate of a single surface, two of such a beating plate are lapped in a condition where they face to each other, and then a single surface is rotated. Pulp is entered from the center portion of the beating plate and is output from the periphery portion by effect of centrifugal force. In the meantime, the pulp is subjected to a mechanical work induced by blades.

A refiner equipped with the above-noted beating plate (disk) is applicable to both a double disk refiner and a single disc refiner. A double disc refiner contains two pairs of rotational disks and a fixed disk provided so as to face the rotational disks.

Various additives can be added to the pulp slurry (hereinafter, may be referred to as "pulp stock") obtained by beating the pulp in accordance with the necessity. Examples of the additives include fillers, dry paper strength agents, sizing agents, wet paper strength agents, fixing agents, pH adjusters, and other agents.

Examples of the filler include calcium carbonate, clay, kaolin, white earth, talc, titanium oxide, diatomaceous earth, barium sulfate, aluminum hydroxide, and magnesium hydroxide.

Examples of the dry paper strength agent include cationized starch, cationized polyacrylamide, anionized polyacrylamide, amphoteric polyacrylamide, and carboxy-modified polyvinyl alcohol.

Examples of the sizing agent include fatty acid salt, rosin derivatives such as rosin and maleated rosin; and compounds having higher fatty acids such as paraffin wax, alkylketenedimer, alkenyl succinic anhydride (ASA), and epoxidized fatty acid amide.

Examples of the wet paper strength agent include polyamine polyamide epychlorohydrin, melamine resin, urea resin, and epoxidized polyamide resin.

Examples of the fixing agent include polyvalent metal salts such as aluminum sulfate, and aluminum chloride; and cationic polymers such as cationized starch.

Examples of the pH adjuster include caustic soda, and sodium carbonate.

Examples of the other agents include antifoaming agents, dyes, slime controlling agents, and fluorescent brightening agents.

Further, a softening agent and the like may be added thereto in accordance with the necessity. For the softening agent, those described in the "SHIN-KAMIKAKO BINRAN (New Paper Processing Handbook)" edited by Shiyaku Times, pp. 554-555 (1980).

Each of these additives may be used alone or in combination with two or more. The amount of each of these various additives to be added to the pulp stock is not particularly limited and may be suitably adjusted in accordance with the intended use, however, it is preferably 0.1% by mass to 1.0% by mass.

The pulp stock which is the pulp slurry to which the various types of additives are added in accordance with the necessity is to be machined by using paper-making machines such as a manual paper-making machine, a long-net paper-making machine, a round-net paper-making machine, a twin-wire machine, a combination machine, and thereafter is dried for preparing the raw paper. When necessary, either before or after the drying, a surface sizing treatment can be carried out.

Examples of surface sizing treatment liquids used for the surface sizing treatment include at least one metal salt selected from alkaline metal salt and alkaline earth metal salt, water-soluble high molecular compound, fluorescent whitening agent, waterproof substance, pigment, dye and the like.

As the at least one the metal salt selected from the alkaline metal salt and the alkaline earth metal salt, those described above can be used.

The water-soluble high molecular compound is not particularly limited, and can be suitably selected in accordance with the intended use. Examples of the water-soluble high molecular compounds include polyvinyl alcohol, carboxy-modified polyvinyl alcohol, carboxymethyl cellulose, hydroxyethyl cellulose, cellulose sulfate, polyethylene oxide, gelatin, cationized starch, casein, sodium polyacrylate, sodium salt of styrene-maleic acid anhydride copolymer, and sodium polystyrene sulfonate. Of these, polyvinyl alcohol, carboxy-modified polyvinyl alcohol, carboxymethyl cellulose, hydroxyethyl cellulose, cellulose sulfate, polyethylene oxide, and gelatin are preferable, and particularly polyvinyl alcohol (PVA) is more preferable.

The content of the water-soluble high molecular compound is preferably 0.5 $g/m^2$ to 2 $g/m^2$.

Examples of the fluorescent whitening agents include stilbene compounds, coumarin compounds, biphenyl compounds, benzo-oxazoline compounds, naphthalimide compounds, pyrazoline compounds, carbostyryl compounds, diamino stilbene disulfonic acid derivatives, imidazole derivatives, coumarin derivatives, triazole derivatives, carbazole derivatives, pyridine derivatives, naphthalic acid derivatives, and imidazolone derivatives. Among these, stilbene compound is preferable.

The content of the florescent whitening agent is not particularly limited, and it is preferably 0.01% by mass to 0.5% by mass, and more preferably 0.02% by mass to 0.2% by mass.

Examples of the waterproof materials include latex emulsions such as styrene-butadiene copolymer, ethylene-vinyl acetate copolymer, polyethylene, and vinylidene chloride copolymer; and polyamide polyamine epichlorohydrin.

Examples of the pigments include calcium carbonate, clay, kaolin, talc, barium sulfate, and titanium oxide.

As for the above-mentioned paper, to improve the rigidity (stiffness) and dimension stability of the image-recording material support, it is preferred that the ratio (Ea/Eb) of the longitudinal Young's modulus (Ea) to the lateral Young's modulus (Eb) is within a range from 1.5 to 2.0. When the ratio (Ea/Eb) is less than 1.5 or more than 2.0, the rigidity (stiffness) and dimension stability of the image-recording material support tend to degrade, and may cause inconveniences to traveling property during transportation.

It has been found that, in general, the "rigidity (stiffness)" of the paper differs based on differences in the way the paper is beaten, and the elasticity modulus of paper from papermaking after beating can be used as an important indication of the "rigidity (stiffness)" of the paper. The elasticity modulus of the paper can be calculated from the following equation by using the relation of the density and the dynamic modulus which shows the physical properties of a viscoelastic object, and by measuring the velocity of sound propagation in the paper using an ultrasonic oscillator.

$$E=\rho c^2(1-n^2)$$

where "E" represents dynamic modulus; "ρ" represents density; "c" represents the velocity of sound in paper; and "n" represents Poisson's ratio.

As n=0.2 or so in a case of ordinary paper, there is not much difference in the calculation, even when the calculation is performed by the following equation:

$$E=\rho c^2$$

Accordingly, when the density of the paper and acoustic velocity can be measured, the elasticity modulus can easily be calculated. In the above equation, when measuring acoustic velocity, various instruments known in the art may be used, such as a Sonic Tester SST-110 (available from Nomura Shoji Co., Ltd.) or the like.

The structure, thickness, size and the like of the paper are not particularly limited and may be suitably selected in accordance with the intended use. For example, the paper may have a single structure or may be formed in a laminate structure of two or more layers.

The thickness of the paper is not particularly limited, may be suitably selected in accordance with the intended use, and it is preferably 30 μm to 500 μm, and more preferably 50 μm to 300 μm, and still more preferably 100 μm to 250 μm. The basis weight of the paper is not particularly limited and may be suitably selected in accordance with the intended use, and for example, it is preferably from 50 g/m$^2$ to 250 g/m$^2$, and more preferably from 100 g/m$^2$ to 200 g/m$^2$.

The density of the paper is not particularly limited and may be suitably selected in accordance with the intended use, however, it is preferably 0.85 g/cm$^3$ to 1.00 g/cm$^3$. When the density of the paper is less than 0.85 g/cm$^3$ or less, the rigidity (stiffness) of the paper may be insufficient to cause degradation in anti-curling property, and the planality of the image recording material support may be degraded.

The water holding property of the paper is preferably 110% to 190%.

The method of drying the paper is not particularly limited and may be suitably selected in accordance with the intended use. Examples thereof include dry treatment using a press machine, dry treatment using a cast drum, and dry treatment using a cylinder.

After the dry treatment, the paper is preferably subjected to a calender treatment.

The calender treatment is not particularly limited and may be suitably selected in accordance with the intended use, however, high-temperature soft calender treatment is preferable. The surface temperature of the metal roller is preferably 110° C. or more, more preferably 150° C. or more, and still more preferably 250° C. or more. For the upper limit temperature, for example, about 300° C. is appropriate.

By subjecting the paper to the calender treatment, paper having high-glossiness can be obtained.

—Polymer Coat Layer—

It is preferred that the paper preferably has a polymer coat layer on at least one surface thereof and more preferably has a polymer coat layer on both surfaces thereof in terms of preventing occurrences of curl.

The polymer coat layer contains a thermoplastic resin and further contains other components in accordance with the necessity.

The thermoplastic resin is not particularly limited and may be suitably selected in accordance with the intended use. Examples thereof include polyolefin resins, polyvinyl chloride resins, polyethylene terephthalate resins, polystyrene resins, polymethacrylate resins, polycarbonate resins, polyimide resins, and triacetyl celluloses. Each of these may be used alone or in combination with two or more. Of these, polyolefin resin is particularly preferable.

The polyolefin resin is not particularly limited and may be suitably selected in accordance with the intended use. Examples thereof include homopolymers of α-olefin such as polyethylene and polypropylene, and mixtures of these various homopolymers. Particularly, high-density polyethylene (HDPE), low-density polyethylene (LDPE), or mixture thereof is preferable. Of these, to increase heat resistance of paper, it is preferable to use polypropylene, a blended compound of polypropylene with polyethylene, high-density polyethylene, or a blended compound of high-density polyethylene and low-density polyethylene. It is particularly preferred to use a blended compound between high-density polyethylene and low-density polyethylene.

The blend ratio (mass ratio) of the high-density polyethylene with the low-density polyethylene is not particularly limited and may be suitably selected in accordance with the intended use. For example, it is preferably 1/9 to 9/1, more preferably 2/8 to 8/2, and still more preferably 3/7 to 7/3.

Both of the high-density polyolefin resin and the low-density polyethylene preferably have a melt index of 1.0 g/10 minutes to 40 g/10 minutes and extrusion suitability.

The weighted average molecular mass of the polyolefin resin is not particularly limited and may be suitably selected in accordance with the intended use, provided that the polyolefin resin can be extrusion-coated. For example, the weighted average molecular mass is preferably 20,000 to 200,000.

Preferably, at least one surface of the paper, and more preferably both surfaces thereof are formed using a blended compound between high-density polyethylene and low-density polyethylene.

The resin density of the low-density polyethylene (LDPE) is preferably 0.930 g/cm$^3$ or less, and more preferably 0.925 g/cm$^3$ or less.

The resin density of the high-density polyethylene (HDPE) is preferably 0.945 g/cm$^3$ or more.

Examples of the various additives include, in order to carry out a treatment to impart white reflectiveness to the image recording material support, white pigments known in the art which are typified by titanium oxides.

The thickness of the polymer coat layer is not particularly limited and may be suitably selected in accordance with the intended use, however, it is preferably 15 μm to 100 μm.

(Method for producing Image Recording Material Support)

The method for producing an image recording material support of the present invention is a method for producing the image recording material support of the present invention and includes beating a pulp using a refiner equipped with a beating plate having an average blade angle of 10 degrees or less and further contains other steps suitably selected in accordance with the necessity.

In the beating, from the perspective that the ratio of long fiber pulp can be controlled with stability, it is preferable that the pulp is beaten while positively rotating and reversely rotating the beating plate alternately at every 10,000,000 revolutions to thereby beat the pulp.

In the beating, the pulp is preferable beaten such that the freeness is adjusted to 200 mL to 400 mL. More preferably, the freeness is 280 mL to 350 mL. When the freeness is less than 200 mL, webs of the paper may be torn during operation due to the reduced ratio of long fibers, and various strengths such as rigidity strength may degrade. When the freeness is more than 400 mL, the increased ratio of long fibers may cause texture defects, degradation of glossiness and planality, and various strengths such as tension strength accompanied by reduction in inter-fiber binding points and rigidity may degrade.

The freeness was measured based on the Canadian Standard specified in JIS P8121 "Pulp Freeness Tester".

Examples of the other steps include a dry treatment step, a calender treatment step, and a polymer coat layer forming step. In the polymer coat layer forming step, for example, on a surface of the paper with at least an image recorded thereon or preferably on both surfaces of the paper after subjecting the surface or both surfaces to a corona discharge treatment, the polymer coat layer is formed by extrusion coating.

An extrusion coating unit used when materials forming each of the coating layers is not particularly limited, may be suitably selected in accordance with the intended use, and examples thereof include ordinary polyolefin-extruders and laminators.

(Image Recording Material)

The image recording material of the present invention contains at least an image recording layer on the image recording material support and further contains other layers in accordance with the necessity.

—Image Recording Layer—

The image recording layer varies in accordance with the application and type of the image recording material. For example, an electrophotographic material is used for a toner image-receiving layer; a heat-sensitive material is used for a heat color developing layer; a sublimation transfer material is used for an image forming layer which develops an image to thermal-diffusible pigments; a thermal transfer material is used for an image forming layer which develops an image to hot-melt inks; a silver halide photography material is used for an image forming layer which develops an image to each pigment of at least yellow (Y), magenta (M), cyan (C), and the like; an inkjet recording material is used for a color material receiving layer capable of receiving water-based inks or oil-based inks.

The image recording layer is not particularly limited, may be suitably selected in accordance with the intended use, and preferred examples thereof include a resin coating layer. The resin coating layer contains at least a polymer and further comprises other components suitably selected in accordance with the necessity.

The polymer used in the resin coating layer is not particularly limited and may be suitably selected in accordance with the intended use, provided that a coating solution containing a resin composition can be prepared using the polymer. A thermoplastic resin is preferably used. Examples of the thermoplastic resin include (1) polyolefin resins, (2) polystyrene resins, (3) acrylic resins, (4) polyvinyl acetates or derivatives thereof, (5) polyamide resins, (6) polyester resins, (7) polycarbonate resins, (8) polyether resins (or acetal resins), and (9) other resins. Each of these thermoplastic resins may be used alone or in combination with two or more.

Examples of the (1) polyolefin resin include polyolefin resins such as polyethylene, and polypropylene; copolymer resins of olefin and other vinyl monomers such as ethylene, and propylene. Examples of the copolymer resins between olefin and other vinyl monomers include ethylene-vinyl acetate copolymers, ionomer resin which is a copolymer between acrylic acid and methacrylic acid. Examples of derivatives of polyolefin resin include chlorinated polyethylene, and chlorsulfonated polyethylene.

Examples of the (2) polystyrene resin include polystyrene resins, styrene-isobutylene copolymers, acrylonitrile-styrene copolymers (AS resins), acrylonitrile-butadiene-styrene copolymers (ABS resins), and polystyrene-maleic acid anhydride resins.

Examples of the (3) acrylic resin include polyacrylic acid or esters thereof, polymethacrylic acid or esters thereof, polyacrylonitrile, and polyacrylamide. Properties of the polyacrylic acid esters and polymethacrylic acid esters greatly vary depending on the type of ester group. Other examples of the acrylic resin are copolymers with other monomers such as acrylic acid, methacrylic acid, styrene, vinyl acetate, and the like. The polyacrylonitrile is more frequently used as copolymers of the above-noted AS resin, and ABS resin than as a homopolymer.

Examples of the (4) polyvinyl acetate or derivatives thereof include polyvinyl acetate, polyvinyl alcohols that can be obtained by saponifying polyvinyl acetate, and polyvinyl acetal resins that can be obtained by reacting polyvinyl alcohol with aldehyde such as formaldehyde, acetaldehyde, and butylaldehyde.

The (5) polyamide resin is a polycondensate between diamine and dibasic acid, and examples thereof include 6-nylon, and 6,6-nylon.

The (6) polyester resin is a polycondensate between alcohol and acid, and properties thereof vary depending on the combination. Examples thereof include general-purpose resin polyethylene terephthalate, and polybutylene terephthalate which are prepared from aromatic dibasic acid and divalent alcohol.

Typical examples of the (7) polycarbonate resin are polyester carbonates obtainable from bisphenol A and phosgene.

Examples of the (8) polyether resin (or acetal resin) include polyether resins such as polyethylene oxide, and polypropylene oxide, and acetal resins such as polyoxymethylene as ring-opening polymerization.

Examples of the (9) other resins include polyaddition polyurethane resins.

It is preferred that the resin coating layer is formed using a waterborne polymer such as water dispersible polymer, and water-soluble polymer on the following grounds. Namely, the waterborne polymers involve no discharge of organic solvent in a coating and drying step, and excel in environmental suitability, and workability. In addition, the waterborne polymers are suitably used as solvents such as a releasing agent contained particularly in a toner image-receiving layer, easily induce bleeding on a surface of the resin coating layer in the coating and drying step, allow for easy obtaining effect of a releasing agent, and further, water-dispersible polymers are more stable in condition and more excellent in production applicability than water-soluble polymers.

For the waterborne polymer, self-dispersible waterborne polyester emulsion or water-dispersible acrylic resin is more preferable on the following grounds. Namely, the self-dispersible waterborne polyester emulsion or water-dispersible acrylic resin is self-dispersible polyesters using no surfactant therein, and thus, hygroscopicity thereof is low even under a high-humidity atmosphere, causes less reduction in softening point due to moisture, allows preventing offset occurrence at the time of fixing of the resin coating layer as well as occurrences of adhesion swollenness between sheets during storage, and a polyester resin which easily take a molecular structure having a high-cohesive energy is used therein. Therefore, the waterborne polymer is in a fused condition of low elasticity (low viscosity) in a fixing step of an electrophotographic material using a toner image-receiving layer as the image recording layer while having a sufficient hardness in storage environment to allow achieving sufficiently high-quality when a toner is embedded in an image-receiving layer.

The waterborne polymer is not particularly limited as to bonding structure, molecular structure, molecular mass, molecular mass distribution, form. Examples of the aqueous group of the waterborne thermoplastic resin include sulfonic group, hydroxyl group, carboxylic group, amino group, amide group, ether group.

Examples of the water-dispersible polymer include water-dispersible resins such as water-dispersible acrylic resin, water-dispersible polyester resin, water-dispersible polyethylene resin, and water-dispersible urethane resins; water-dispersible emulsions such as acrylic resin emulsion, polyvinyl acetate emulsion, and SB (styrene-butadiene-rubber) emulsion; resins or emulsions with a thermoplastic resin water-dispersed therein such as resins having an ester bond, polyurethane resin, polyamide resin, polysulfone resin, polyvinylchloride resin, polyvinyl butyral, polycaprolacton resins, and polyolefin resin; and copolymers thereof, mixtures thereof, and cation-modified ones. Of these, two or more may be suitably selected to use.

The water-dispersible emulsion is not particularly limited and may be suitably selected in accordance with the intended use. Examples of such emulsions include water-dispersible polyurethane emulsions, water-dispersible polyester emulsions, chloroprene emulsions, styrene-butadiene emulsions, nitrile-butadiene emulsions, butadiene emulsions, vinyl chloride emulsions, vinylpyridine-styrene-butadiene emulsions, polybutene emulsions, polyethylene emulsions, vinyl acetate emulsions, ethylene-vinyl acetate emulsions, vinylidene chloride emulsions, and methyl methacrylate-butadiene emulsions. Of these, water-dispersible polyester emulsions are particularly preferable.

Examples of commercially available products of the water-dispersible polymer include, as for polyester water-dispersible polymers, Byronal series by Toyobo Co., Ltd.; PESRESIN by Takamatsu Oil & Fats Co., Ltd.; Tufton UE series by Kao Corporation; Polyester WR series by NIPPON Synthetic Chemical Industry Co., Ltd.; ELIETEL series by UNITIKA LTD; as for acrylic water-dispersible polymers, Hyros XE, KE, PE series by Seiko Chemical Industries Co., Ltd., and Julimer ET series by Nihon Junyaku Co., Ltd.

The water-soluble polymer is not particularly limited and may be suitably selected in accordance with the intended use. Examples thereof include polyvinyl alcohol, carboxy-modified polyvinyl alcohol, carboxy-methyl cellulose, hydroxyethyl cellulose, cellulose sulfate, polyethylene oxide, gelatin, cationized starch, casein, sodium polyacrylate, sodium salt of styrene-maleic acid anhydride copolymer, and polystyrene sodium sulfonate. Of these, polyethylene oxide is preferable.

Examples of the water-soluble polymers are given on page 26 of Research Disclosure No. 17,643, page 651 of Research Disclosure No. 18,716, pp. 873-874 of Research Disclosure No. 307,105, and JP-A No. 64-13546.

Specifically, it is possible to use vinylpyrolidone-vinyl acetate copolymer, styrene-vinylpyrolidone copolymer, styrene-maleic acid anhydride, water-soluble polyester, water-soluble acrylic resin, water-soluble polyurethane, water-soluble nylon, or water-soluble epoxy resin. The gelatin can be selected from lime-treated gelatin, acid-treated gelatin, and so-called decalcified gelatin of which the content of calcium etc. is reduced, and it is preferable to use a combination of the above-mentioned for use.

Examples of commercially available products of water-soluble polymer include various Plascoat products by Goo Chemical Co., Ltd.; Finetex ES series by Dainippon Ink and Chemicals Inc.; and those of water-soluble acrylic resins include Jurymer AT series by Nihon Junyaku Co., Ltd.; Finetex 6161 and K-96 by Dainippon Ink and Chemicals Inc.; Hyros NL-1189 and BH-997L by Seiko Chemical Industries Co., Ltd.

The content of the waterborne polymer in the resin coating layer is not particularly limited, may be suitably selected in accordance with the intended use, and it is preferably 20% by mass or more based on the mass of the resin coating layer, and more preferably 30% by mass to 100% by mass.

As for the thermoplastic resin used for the resin coating layer, it is preferable to use those satisfying physical properties disclosed in Japanese Patent Application Laid-Open (JP-A) Nos. 05-127413, 08-194394, 08-334915, 08-334916, 09-171265, and 10-221877.

For the other components to be contained in the resin coating layer, crosslinkers, UV or EB curing agents, for example, additives such as plasticizers, lubricants, releasing agents, colorants, fillers, charge controlling agents, emulsifiers, and dispersing agents can be added as long as the function of the resin coating layer is not impaired.

The image-recording material support is preferably used as printing paper. In this case, the support is preferred to have high mechanical strength since the ink is to be applied by means of a printing machine. Among the image recording material supports, laminate paper is more preferable. As for the printing paper, the resin coating layer is formed on a surface of the image recording material support of the present invention.

The printing paper can be particularly preferably used as offset printing paper. Besides, it can be used as letterpress printing paper, gravure printing paper, and electrophotographic paper.

—Electrophotographic Material—

The electrophotographic material has at least the toner image-receiving layer as the image recording layer on a surface of the image recording material support and further has other layers suitably selected in accordance with the necessity. These layers may be individually formed as a single structure or may be formed in a laminate structure.

[Toner-Image Receiving Layer]

The toner image-receiving layer receives a color toner or a black toner and forms an image. The toner image-receiving layer has a function to receive toner which forms an image from a developing drum or an intermediate transfer by (static) electricity or pressure in a transferring step and to fix the image by heat or pressure in a fixing step.

The light transmittance of the toner image-receiving layer is preferably 78% or less, more preferably 73% or less, and still more preferably 72% or less, from the perspective of making the photographic material have a texture close to photograph.

Here, the light transmittance can be measured by forming a coating layer having a same thickness on a polyethylene terephthalate film (100 μm), and measuring the thickness of the coating layer using a direct reading hazemeter (HGM-2DP, available from Suga Tester Co., Ltd.).

The 180-degree peel strength of the toner image-receiving layer to a fixing member of an image forming apparatus in the fixing temperature is preferably 0.1 N/25 mm or less, and more preferably 0.041 N/25 mm or less. The 180-degree peel strength can be measured using the surface material of the fixing member in accordance with the method described in JIS K 6887.

It is preferred that the toner image-receiving layer has a high degree of whiteness. This whiteness is measured by the method specified in JIS P 8123, and is preferably 85% or more. It is preferred that the spectral reflectance is 85% or more in the wavelength range of 440 nm to 640 nm, and that the difference between the maximum spectral reflectance and the minimum spectral reflectance in this wavelength range is within 5%. Further, it is more preferred that the spectral reflectance is 85% or more in the wavelength range from 400 nm to 700 nm, and that the difference between the maximum spectral reflectance and the minimum spectral reflectance in the wavelength is within 5%.

Specifically, for the whiteness of the toner image-receiving layer, the value of L* is preferably 80 or more, more preferably 85 or more, and still more preferably 90 or more in a CIE 1976 (L* a* b*) color space. The color tint of the white color is preferably as neutral as possible. Regarding the color tint of the whiteness, the value of $(a^*)^2+(b^*)^2$ is preferably 50 or less, more preferably 18 or less, and still more preferably 5 or less in the (L* a* b*) space.

It is preferred that the toner image-receiving layer has a high surface gloss after being formed. The 45° gloss luster is preferably 60 or more to 110 or less, over the whole range from white where there is no toner, to black where toner is densed at maximum. For the minimum 45° gloss luster is preferably 75 or more, and more preferably 90 or more.

When the gloss luster is more than 110, the image has a metallic luster which is undesirable.

The gloss luster may be measured by JIS Z 8741.

It is preferred that the toner image-receiving layer has high smoothness after being fixed. The arithmetic average roughness (Ra) is preferably 3 μm or less, more preferably 1 μm or less, and still more preferably 0.5 μm or less, over the whole range from white where there is no toner, to black where toner is densed at maximum.

The arithmetic average roughness may be measured by JIS B 0601, JIS B 0651, and JIS B 0652.

It is preferred that the toner image-receiving layer has one of the following physical properties, more preferred that the toner image-receiving layer has several of the following physical properties, and most preferred that the toner image-receiving layer has all of the following physical properties.

(1) $T_m$ (melting temperature of toner image-receiving layer) is preferably 30° C. or more, and more preferably equal to or less than $T_m$ (melting temperature of toner)+20° C.

(2) The temperature at which the viscosity of the toner image-receiving layer is $1\times10^5$ cp is preferably 40° C. or higher, and more preferably lower than the corresponding temperature for the toner.

(3) At a fixing temperature of the toner image-receiving layer, the storage elasticity modulus (G') is preferably $1\times10^2$ Pa to $1\times10^5$ Pa, the loss elasticity modulus (G") is preferably from $1\times10^2$ Pa to $1\times10^5$ Pa.

(4) The loss tangent (G"/G'), which is the ratio of the loss elasticity modulus (G") to the storage elasticity modulus (G') at a fixing temperature of the toner image-receiving layer, is preferably from 0.01 to 10.

(5) The storage elasticity modulus (G') at a fixing temperature of the toner image-receiving layer is preferably from −50 to +2,500 relative to the storage elasticity modulus (G') at a fixing temperature of the toner.

(6) The inclination angle on the toner image-receiving layer of the molten toner is preferably 50° or less, and more preferably 40° or less.

The toner image-receiving layer preferably satisfies the physical properties described in Japanese Patent No. 2788358, and JP-A Nos. 07-248637, 08-305067 and 10-239889.

It is preferred that the surface electrical resistance of the toner image-receiving layer is $1\times10^6$ Ω/cm$^2$ to $1\times10^{15}$ Ω/cm$^2$ (under the conditions of 25° C., 65% RH).

When the surface electrical resistance is less than $1\times10^6$ Ωcm$^2$, the toner amount transferred to the toner image-receiving layer is insufficient, and the density of the toner image obtained may be excessively low. On the other hand, when the surface electrical resistance is more than $1\times10^{15}$ Ω/cm$^2$, more charge than necessary is produced during transfer. Therefore, toner is transferred insufficiently, image density is low and static electricity develops, thus causing dust to adhere during handling of the electrophotographic image-receiving paper sheet. Moreover in this case, misfeed, overfeed, discharge marks, toner transfer dropout and the like may occur during the copying.

The surface electrical resistances are measured based on JIS K 6911. The sample is left in am air-conditioned room for 8 hours or more under the conditions of 20° C. and 65% relative humidity. Measurements are made using an R8340 produced by Advantest Ltd., under the same environmental conditions after giving an electric current for 1 minute at an applied voltage of 100 V.

The toner image-receiving layer is preferably the resin coating layer. The resin coating layer as the toner image-receiving layer contains at least a polymer for the toner image-receiving layer and further contains other components in accordance with the necessity.

<Polymer for Toner Image-Receiving Layer>

The polymer for the toner image-receiving layer may be a polymer that satisfies the above-noted physical properties of the toner image-receiving layer using a combination of two or more of the polymers, provided that the physical properties of the toner image receiving layer can be satisfied in the condition where the toner image-receiving layer is formed, or may be a polymer that can satisfies the physical properties of the toner image-receiving layer by the use of the polymer alone.

Preferably, the polymer for the toner image-receiving layer has a greater molecular mass that that of a thermoplastic resin used in the toner. However, the above-noted molecular mass relation is not necessarily preferable depending on the relation of thermodynamic properties between the thermoplastic resin used in the toner and the polymer for the toner image-receiving layer. For example, when the polymer for the toner image-receiving layer has a higher softening temperature than that of the thermoplastic resin used in the toner, it may be preferred that the resin used in the toner image-receiving layer has an equal softening temperature to or a lower softening temperature than that of the thermoplastic resin used in the toner.

In addition, it is preferred that plural resins each having the same composition but having a different average molecular mass each other are mixed and used for the polymer for the toner image-receiving layer. For the relation with the molecular mass of the thermoplastic resin used in the toner, the relations disclosed in JP-A No. 08-334915 are preferable. Further, it is preferred that the molecular mass distribution of the polymer for the toner image-receiving layer is wider than that of the thermoplastic resin used in the toner. For the polymer for the toner image-receiving layer, those satisfying physical properties disclosed in JP-A Nos. 05-127413, 08-194394, 08-334915, 08-334916, 09-171265, and 10-221877 are preferable.

The polymer for the toner image-receiving layer preferably has the following properties (1) to (5) relative to a polymer for the intermediate layer, which will be described below.

(1) The softening temperature (Ts) of the polymer for the toner image-receiving layer is 10° C. or more, particularly preferably 20° C. or more higher than that of the polymer for the intermediate layer, which will be described hereinafter. By adjusting the softening temperature like this, the glossiness of the polymer can be controlled. The softening temperature can be measured, for example, by the method specified in JIS K 7210.

(2) T½ (½ softening point) of the polymer for the toner image-receiving layer is 10° C. or more, particularly preferably 20° C. or more higher than that of the polymer for the intermediate layer, which will be described hereinafter. By adjusting the ½ softening point like this, the glossiness of the polymer for the toner image-receiving layer can be controlled.

(3) Tfb (Temperature of flow beginning) is 10° C. or more, particularly preferably 20° C. or more higher than that of the polymer for the intermediate layer, which will be described hereinafter. By adjusting the Tfb like this, the glossiness of the polymer for the toner image-receiving layer can be controlled.

(4) The viscosity of the polymer for the toner image-receiving layer at a fixing temperature of toner is three times or more, particularly preferably 10 times or more higher than that of the polymer for the intermediate layer, which will be described hereinafter. By adjusting the viscosity like this, the glossiness of the polymer for the toner image-receiving layer can be controlled.

(5) The storage elasticity modulus (G') in the polymer for the toner image-receiving layer at a fixing temperature of toner is three times or more, particularly preferably 10 times or more higher than that of the polymer for the intermediate layer, which will be described below. By adjusting the storage elasticity modulus like this, the glossiness of the polymer for the toner image-receiving layer can be controlled.

(6) The loss elasticity modulus (G") of the polymer for the toner image-receiving layer at a fixing temperature of toner is three times or more, particularly preferably 10 times or more higher than that of the polymer for the intermediate layer, which will be described hereinafter. By adjusting the loss elasticity modulus (G"), the glossiness of the polymer for the toner image-receiving layer can be controlled.

The number average molecular mass of the polymer for the toner image-receiving layer is preferably, for example, 1,000 to 100,000 smaller, particularly 1,000 to 10,000 smaller than that of the polymer for the intermediate layer, which will be described hereinafter. By adjusting the number average molecular mass, the glossiness of the polymer for the toner image-receiving layer can be controlled.

In addition, it is preferred that the molecular mass distribution of the polymer for the toner image-receiving layer is 0.2 to 5 narrower than that of an intermediate layer, which will be described hereinafter. By adjusting the molecular mass distribution, the glossiness of the polymer for the toner image-receiving layer can be controlled.

The polymer for the toner image-receiving layer is not particularly limited and may be suitably selected in accordance with the intended use, provided that the polymer can be deformed under temperature conditions such as in fixing and can receive a toner. However, a resin having the similar composition to a binder resin used for toner. Preferred examples of the polymer for the toner image-receiving layer include thermoplastic resins such as polyester resins, styrene-acrylic acid ester copolymer, styrene-methacrylic acid ester copolymer, since a copolymer resin such as a polyester resin, styrene, or styrene-butyl acrylate is used as the material of toner.

Specific examples of the thermoplastic resin include resins having an ester bond, polyurethane resins, polyamide resins, polysulfone resins, polyvinyl chloride resins, polyvinyl butyrals, polycaprolacton resins, and polyolefin resins, which are exemplarily indicated as the resin coating layer to form the image recording layer.

For the polymer for the toner image-receiving layer, each of the above-noted polymers may be used alone or in combination with two or more. In addition to these polymers, mixtures thereof and copolymers thereof can be used as well.

The polymer for the toner image-receiving layer is excellent in environmental property and workability since no organic solvent is discharged at coating-drying step (i). Many releasing agents such as wax are unlikely to be solved in solvent at room temperature, and are often dispersed, prior to usage, in solvent (water and organic solvent). Water dispersing form is more stable and is more adaptive to production steps. Moreover, an aqueous coating is more likely to cause bleeding of wax on the surface in the process of coating-drying, thus making it easier to obtain the effect of the releasing agent (antioffset property, adhesive resistance and the like). For the above reasons, aqueous resins such as water-dispersible polymer, water-soluble polymer and the like are preferably used.

The above aqueous resins, provided that they are either the water-dispersible polymer or the water-soluble polymer, are not particularly limited in terms of composition, bonding structure, molecular structure, molecular mass, molecular mass distribution, form and the like, and can be suitably selected in accordance with the intended use. Examples of aqueous group of the above polymers include sulfonic group, hydroxyl group, carboxylic group, amino group, amide group, ether group and the like.

The above water-dispersible polymer can be made, for example, by suitably selecting from the following and combining two or more of them: i) resins made by dispersing in water the polymers for toner image-receiving layer numbered by (1) to (9) above, ii) emulsions made by dispersing in water the polymers for toner image-receiving layer numbered by (1) to (9) above, iii) copolymer thereof, iv) mixture thereof, and v) cationic modified product.

The water-dispersible polymer can be suitably synthesized for use, or those commercially available are usable. Examples of commercially available products of the water-dispersible polymers include polyester resins such as Vylonal series by Toyobo Co., Ltd., Pesresin A series by Takamatsu Oil & Fat Co., Ltd., Tuftone UE series by Kao Corp., Nichigo Polyester WR series by Nippon Synthetic Chemical Industry Co., Ltd., Elitel series by Unitika Ltd. and the like; and acrylic resins such as Hiros XE, KE, and PE series by Seiko Chemical Industries Co., Ltd., Jurymer ET series by Nihon Junyaku Co., Ltd. and the like.

The water-dispersible emulsion can be any suitable emulsion that preferably has a volume-average particle diameter of 20 nm or more. Examples of such emulsions are water-dispersible polyurethane emulsions, water-dispersible polyester emulsions, chloroprene emulsions, styrene-butadiene emulsions, nitrile-butadiene emulsions, butadiene emulsions, vinyl chloride emulsions, vinylpyridine-styrene-butadiene emulsions, polybutene emulsions, polyethylene emulsions, vinyl acetate emulsions, ethylene-vinyl acetate emulsions, vinylidene chloride emulsions, and methyl methacrylate-butadiene emulsions. Among them, water-dispersible polyester emulsions are preferred.

The water-dispersible polyester emulsions are preferably self-dispersible aqueous polyester emulsions, of which self-dispersible aqueous carboxyl-containing polyester emulsions are typically preferred. The "self-dispersible aqueous polyester emulsion" herein means an aqueous emulsion containing a polyester resin that is self-dispersible in an aqueous solvent without the use of an emulsifier and the like. The "self-dispersible aqueous carboxyl-containing polyester emulsion" means an aqueous emulsion containing a polyester that contains carboxyl groups as hydrophilic groups and is self-dispersible in an aqueous solvent.

The self-dispersible aqueous polyester emulsion preferably satisfies the following requirements (1) to (4). This type of polyester resin emulsion is self-dispersible requiring no surfactant, is low in moisture absorbency even in an atmosphere at high humidity, exhibits less decrease in its softening point due to moisture and can thereby avoid offset in image-fixing and failures due to adhesion between sheets during storage. The emulsion is water-based and is environmentally friendly and excellent in workability. In addition, the polyester resin used herein readily takes a molecular structure with high coagulation energy. Accordingly, the resin has sufficient hardness (rigidity) during its storage but is melted with low elasticity and low viscosity during an image-fixing process for electrophotography, and the toner is sufficiently embedded in the toner-image-receiving layer to thereby form images having sufficiently high quality.

(1) The number-average molecular mass Mn is preferably from 5,000 to 10,000 and more preferably from 5,000 to 7,000.

(2) The molecular mass distribution (Mw/Mn) is preferably 4 or less, and more preferably 3 or less, wherein Mw is the weight-average molecular mass.

(3) The glass transition temperature Tg is preferably from 40° C. to 100° C. and more preferably from 50° C. to 80° C.

(4) The volume average particle diameter is preferably from 20 nm to 200 nm and more preferably from 40 nm to 150 nm.

The content of the water-dispersible emulsion in the toner image-receiving layer is preferably 10% by mass to 90% by mass, and more preferably 10% by mass to 70% by mass.

The water-soluble polymer is not particularly limited, provided that the weight average molecular mass (Mw) is 400,000 or less, and can be suitably selected in accordance with the intended use. The water-soluble polymer can be suitably synthesized for use, or commercially available product thereof can be used. Examples of the water-soluble polymers include polyvinyl alcohol, carboxy-modified polyvinyl alcohol, carboxymethyl cellulose, hydroxyethyl cellulose, cellulose sulfate, polyethylene oxide, gelatin, cationic starch, casein, sodium polyacrylate, sodium styrene-maleic acid anhydride copolymer: styrene-maleic acid anhydride copolymer), sodium polystyrene sulfonate and the like. Among the above, polyethylene oxide is preferable.

Examples of commercially available products of water-soluble polymer include various Plascoat products by Goo Chemical Co., Ltd., Finetex ES series by Dainippon Ink and Chemicals Inc. and the like; and those of water-soluble acrylic resins include Jurymer AT series by Nihon Junyaku Co., Ltd., Finetex 6161 and K-96 by Dainippon Ink and Chemicals Inc., Hiros NL-1189 and BH-997 by Seiko Chemical Industries Co., Ltd. and the like.

Examples of the water-soluble resins are given on page 26 of Research Disclosure No. 17,643, page 651 of Research Disclosure No. 18,716, pp. 873-874 of Research Disclosure No. 307,105, and JP-A No. 64-13546.

The content of the water-soluble polymer in the toner image-receiving layer is not particularly limited and may be suitably selected in accordance with the intended use, and it is preferably 0.5 $g/m^2$ to 2 $g/m^2$.

The thermoplastic resin can be used in combination with other polymer materials. In this case, the content of the thermoplastic resin is typically to be used so as to be greater than that of the other polymer materials.

For the toner image-receiving layer, at least any one of the water-dispersible emulsion and the water-soluble polymer can be used alone, or both of them can be used concurrently.

It is preferred that the absorbed amount of the water-soluble polymer in a coating solution for the toner image-receiving layer in which the water-dispersible emulsion is used in combination with the water-soluble polymer is less than 2% by mass.

When the absorbed amount of the water-soluble polymer is more than 2% by mass, the coating solution for the toner image-receiving layer containing the water-dispersible emulsion and the water-soluble polymer may flocculate.

The absorbed amount of the water-soluble polymer can be determined as follows. The water-dispersible emulsion and the water-soluble polymer are mixed at a mass ratio of 100:17 (water-dispersible emulsion:water-soluble polymer); the mixture is put in a centrifugal machine to be centrifugalized; the amount of the water-soluble polymer (polyethylene oxide) dissolved in the supernatant solution, which has been centrifugalized is quantitated using an NMR; and then the absorbed amount (% by mass) of the water-soluble polymer can be determined from the added amount of the polyethylene oxide. When the absorbed amount is 2% by mass to 5% by mass, it means that deprivation and flocculation has occurred.

When the absorbed amount is more than 30% by mass, it means that flocculation has occurred due to absorption or crosslinking reaction.

The mass ratio of the water-dispersible emulsion and the water-soluble polymer in the case where the water-dispersible emulsion is used in combination with the water-soluble polymer (water-dispersible emulsion:water-soluble polymer) is preferably 1:0.01 to 1, and more preferably 1:0.1 to 1.

The content of the polymer for the toner image-receiving layer in the toner image receiving layer is preferably 10% by mass or more, more preferably 30% by mass or more, still more preferably 50% by mass or more, and particularly preferably 50% by mass to 90% by mass.

<Other Components>

Examples of the other components to be contained in the toner image-receiving layer include releasing agents, plasticizers, colorants, fillers, crosslinkers, charge controlling agents, and other additives.

The releasing agent can be blended to the toner image-receiving layer in order to prevent offset of the toner image-receiving layer. Various types of the releasing agent can be used and may be suitably selected in accordance with the intended use as long as it is able to form a layer of the releasing agent on a surface of the toner image-receiving layer by being heated and melted at a fixing temperature so as to deposit and to remain on the surface of the toner image-receiving layer, and by being cooled and solidified so as to form a layer of the releasing agent, thereafter.

The releasing agent can be at least one selected from silicone compounds, fluorine compounds, waxes, and matting agents.

The releasing agent may be a compound described in *Kaitei—Wakkusu no seishitsu to ouyou* "Properties and Applications of Wax (Revised)" by Saiwai Publishing, or in the Silicone Handbook published by THE NIKKAN KOGYO SHIMBUN. Also, the silicone compounds, fluorine compounds and wax in the toners mentioned in Japanese Patent Application Publication (JP-B) No. 59-38581, Japanese Patent Application Publication (JP-B) No. 04-32380, Japanese Patent JP-B) No. 2838498, JP-B No. 2949558, Japanese Patent Application Laid-Open JP-A) No. 50-117433, No. 52-52640, No. 57-148755, No. 61-62056, No. 61-62057, No. 61-118760, and JP-A No. 02-42451, No. 03-41465, No. 04-212175, No. 04-214570, No. 04-263267, No. 05-34966, No. 05-119514, No. 06-59502, No. 06-161150, No. 06-175396, No. 06-219040, No. 06-230600, No. 06-295093, No. 07-36210, No. 07-43940, No. 07-56387, No. 07-56390, No. 07-64335, No. 07-199681, No. 07-223362, No. 07-287413, No. 08-184992, No. 08-227180, No. 08-248671, No. 08-248799, No. 08-248801, No. 08-278663, No. 09-152739, No. 09-160278, No. 09-185181, No. 09-319139, No. 09-319143, No. 10-20549, No. 10-48889, No. 10-198069, No. 10-207116, No. 11-2917, No. 11-44969, No. 11-65156, No. 11-73049 and No. 11-194542 may be used. These compounds can also be used in combination with two or more.

Examples of the silicone compounds include silicone oil, silicone rubber, silicone fine-particle, silicone-modified resin, and reactive silicone compound.

Such silicone oils include, for example, unmodified silicon oil, amino-modified silicone oil, carboxy-modified silicone oil, carbinol-modified silicone oil, vinyl-modified silicone oil, epoxy-modified silicone oil, polyether-modified silicone oil, silanol-modified silicone oil, methacrylic-modified silicone oil, mercapto-modified silicone oil, alcohol-modified silicone oil, alkyl-modified silicone oil, and fluorine-modified silicone oil.

Examples of the silicone-modified resins are silicone-modified resins derived from olefinic resins, polyester resins, vinyl resins, polyamide resins, cellulose resins, phenoxy resins, vinyl chloride-vinyl acetate resins, urethane resins, acrylic resins, styrene-acrylic resins, or copolymers comprising at least one of these constitutive monomers.

The fluorine compound is not particularly limited, and can be suitably selected in accordance with the intended use. Examples of the fluorine compounds include fluorine oil, fluoro rubber, fluorine-modified resin, fluorine sulfonic acid compound, fluorosulfonic acid, fluorine acid compound or salt thereof, and inorganic fluoride.

The above waxes are largely classified into two, that is, natural wax and synthetic wax.

The natural wax is preferably at least one wax selected from vegetable wax, animal wax, mineral wax, and petroleum wax, among which vegetable wax is particularly preferable. The natural wax is also preferably a water-dispersible wax, from the viewpoint of compatibility and the like when an aqueous resin is used as the polymer for the toner image-receiving layer.

The vegetable wax is not particularly limited, and can be suitably selected from those known in the art. The vegetable wax may be a commercially available product, or suitably synthesized.

Examples of the vegetable waxes include carnauba wax, castor oil, rapeseed oil, soybean oil, Japan tallow, cotton wax, rice wax, sugarcane wax, candellila wax, Japan wax, jojoba oil, and the like.

Examples of commercially available product of the carnauba wax include EMUSTAR AR-0413 from Nippon Seiro Co., Ltd., and Cellusol 524 from Chukyo Yushi Co., Ltd, and the like.

Examples of commercially available product of the castor oil include purified castor oil from Itoh Oil Chemicals Co., Ltd.

Of these, carnauba wax having a melting point of 70° C. to 95° C. is particularly preferable from the viewpoint of providing an electrophotographic image-receiving paper sheet which is excellent in antioffset properties, adhesive resistance, paper transporting properties, gloss, is less likely to cause crack and splitting, and is capable of forming high-quality image.

The animal wax is not particularly limited, and can be suitably selected from those known in the art. Examples of the animal waxes include bees wax, lanolin, spermaceti, whale oil, wool wax and the like.

The mineral wax is not particularly limited and may be suitably selected from those known in the art. The mineral wax may be a commercially available product, or suitably synthesized. Examples of the mineral waxes include montan wax, montan ester wax, ozokerite, ceresin.

Of these, montan wax having a melting point of 70° C. to 95° C. is particularly preferable from the viewpoint of providing an electrophotographic image-receiving paper sheet which is excellent in antioffset properties, adhesive resistance, paper transporting properties, gloss, is less likely to cause crack and splitting, and is capable of forming high-quality image.

The petroleum wax is not particularly limited and may be suitably selected from those known in the art. The petroleum wax may be a commercially available product, or suitably synthesized. Examples of the petroleum waxes include paraffin wax, a microcrystalline wax, and petrolatum and the like.

The content of the natural wax in the toner image-receiving layer (a surface) is preferably 0.1 $g/m^2$ to 4 $g/m^2$, and more preferably 0.2 $g/m^2$ to 2 $g/m^2$. When the content is less than 0.1 $g/m^2$, the antioffset properties and the adhesive resistance may deteriorate. When the content is more than 4 $g/m^2$, the quality of an image may deteriorate because of the excessive amount of wax.

The melting point of the natural wax is preferably 70° C. to 95° C., and more preferably 75° C. to 90° C., from the viewpoint of antioffset properties and paper transporting properties.

The synthetic waxes are classified into synthetic hydrocarbon, modified wax, hydrogenated wax, and other grease synthetic wax. The synthetic wax is preferably a water-dispersible wax, from the viewpoint of compatibility when an aqueous thermoplastic resin is used as the thermoplastic resin in the toner image-receiving layer.

Examples of the synthetic hydrocarbons include Fischer-tropsch wax, and polyethylene wax.

Examples of the grease synthetic waxes include an acid amide compound (specifically, stearic acid amide and the like), and an acid imide compound (specifically, anhydrous phthalic acid imide and the like).

The modified wax is not particularly limited and may be suitably selected in accordance with the intended use. Examples of the modified waxes include amine-modified wax, acrylic acid-modified wax, fluorine-modified wax, olefin-modified wax, urethane wax, and alcohol wax.

The hydrogenated wax is not particularly limited, and can be suitably selected in accordance with the intended use. Examples of the hydrogenated waxes include cured castor oil, castor oil derivatives, stearic acid, lauric acid, myristic acid, palmitic acid, behenic acid, sebacic acid, undecylenic acid, heptyl acids, maleic acid, and high grade maleic oils.

The matting agent can be selected from any known matting agents. Solid particles used as the matting agent can be classified into inorganic particles and organic particles. Specifically, the inorganic matting agents may be oxides (for example, silicon dioxide, titanium oxide, magnesium oxide, and aluminum oxide), alkaline earth metal salts (for example, barium sulfate, calcium carbonate, and magnesium sulfate), silver halides (for example, silver chloride, and silver bromide), glass and the like.

Examples of the inorganic matting agents can be found in West German Patent No. 2529321, the U.K. Patent Nos. 760775, 1260772, and the U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

Materials of the organic matting agent include starch, cellulose ester (for example, cellulose-acetate propionate), cellulose ether (for example, ethyl cellulose) and a synthetic resin. It is preferred that the synthetic resin is insoluble or difficult to be solved. Examples of synthetic resins that are insoluble or of low solubility in water include poly(meth) acrylates (for example, polyalkyl(meth)acrylate, polyalkoxyalkyl(meth)acrylate, polyglycidyl(meth)acrylate), poly (meth) acrylamide, polyvinyl ester (for example, polyvinyl acetate), polyacrylonitrile, polyolefins (for example, polyethylene), polystyrene, benzoguanamine resin, formaldehyde condensation polymer, epoxy resin, polyamide, polycarbonate, phenolic resin, polyvinyl carbazole, and polyvinylidene chloride.

Copolymers, that is, a combination of monomers used in the above polymers may also be used.

In the case of the copolymers, a small amount of hydrophilic repeating units may be included. Examples of monomers which constitute these hydrophilic repeating units include acrylic acid, methacrylic acid, α,β-unsaturated dicarboxylic acid, hydroxyalkyl(meth)acrylate, sulfoalkyl(meth) acrylate, and styrene sulfonic acid.

Examples of the organic matting agents can be found in the U.K. Patent No. 1055713, the U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, and JP-A Nos. 49-106821, and 57-14835.

Also, two or more types of solid particles may be used in combination. The average particle size of the solid particles may suitably be, for example, 1 μm to 100 μm, and is more preferably 4 μm to 30 μm. The usage amount of the solid particles may suitably be 0.01 $g/m^2$ to 0.5 $g/m^2$, and is more preferably 0.02 $g/m^2$ to 0.3 $g/m^2$.

The melting point (° C.) of the releasing agent is preferably 70° C. to 95° C., and more preferably 75° C. to 90° C., from the viewpoint of antioffset properties and paper transport properties.

The releasing agent used in the present invention which is added to a toner image-receiving layer may also use derivatives, oxides, refined products, or mixtures thereof. These may also have reactive substituents.

The content of the releasing agent, based on the mass of the toner image-receiving layer, is preferably 0.1% by mass to 10% by mass, more preferably 0.3% by mass to 8.0% by mass, and still more preferably 0.5% by mass to 5.0% by mass. The content less than 0.1% by mass may make the antioffset property and adhesion resistance insufficient, while more than 10% by mass may degrade the image quality due to too large an amount of releasing agent.

—Plasticizers—

The plasticizers known in the art may be used without any particular limitation. These plasticizers have the effect of adjusting the fluidity or softening of the toner image-receiving layer due to one of heat and pressure during toner fixing.

The plasticizer may be selected by referring to *Kagaku binran* "Chemical Handbook" (ed. The Chemical Society of Japan, Maruzen), *Kasozai—Sono riron to ouyou* "Plasticizers—Theory and Application" (ed. Koichi Murai, Saiwai Shobo), *Kasozai no kenkyu—jou* "The Study of Plasticizers, Part 1" and *Kasozai no kenkyu—ge* "The Study of Plasticizers, Part 2" (ed. Polymer Chemistry Association), or *Binran—Gomu purasuchikku haigou yakuhin* "Handbook of Rubber and Plastics Blending Agents" (ed. Rubber Digest Co.), or the like.

Examples of the plasticizers include esters (for example, phthalic esters, phosphate esters, aliphatic acid esters, abietic acid ester, adipic acid ester, sebacic acid esters, azelaic ester, benzoates, butyric acid esters, epoxy aliphatic acid esters, glycolic acid esters, propionic acid esters, trimellitic acid esters, citrates, sulfonates, carboxylates, succinic acid esters, maleates, fumaric acid esters, phthalic acid esters, stearic acid esters and the like); amides (for example, aliphatic acid amides and sulfoamides and the like); ethers; alcohols; lactones; polyethyleneoxy; and the like (See JP-A Nos. 59-83154, 59-178451, 59-178453, 59-178454, 59-178455, 59-178457, 62-174754, 62-245253, 61-209444, 61-200538, 62-8145, 62-9348, 62-30247, 62-136646, and 02-235694 and the like). The above plasticizers can be mixed into a resin for use.

The plasticizers may be polymers having relatively low molecular mass. In this case, it is preferred that the molecular mass of the plasticizer is lower than the molecular mass of the binder resin to be plasticized. Preferably, plasticizers have a molecular mass of 15,000 or less, or more preferably 5,000 or less. When a polymer plasticizer is used as the plasticizer, the kind of the polymer of the polymer plasticizer is preferably the same as that of the binder resin to be plasticized. For example, when the polyester resin is plasticized, polyester having low molecular mass is preferable. Further, oligomers may also be used as plasticizers.

Apart from the compounds mentioned above, there are commercial products such as, for example, Adecasizer PN-170 and PN-1430 (available from Asahi Denka Co., Ltd.); PARAPLEX-G-25, G-30 and G-40 (available from C. P. Hall); and, rosin ester (ester gum) 8 L-JA, ester R-95, pentalin 4851, FK 115, 4820, 830, Ruizol 28-JA, Picolastic A75, Picotex LC and Cristalex 3085 (available from Rika Hercules, Inc) and the like.

The plasticizer can be used as desired to relax stress and distortion (physical distortions such as elasticity and viscosity, and distortions of mass balance in molecules, binder main chains or pendant portions) which are produced when toner particles are embedded in the toner image-receiving layer.

The plasticizer may be dispersed in micro in the toner image-receiving layer. The plasticizer may also be dispersed in micro, in a state of sea-island, in the toner image-receiving layer. The plasticizer may present in the toner image-receiving layer in a state of sufficiently mixed with other components such as binder or the like.

The content of plasticizer in the toner image-receiving layer is preferably 0.001% by mass to 90% by mass, more preferably 0.1% by mass to 60% by mass, and still more preferably 1% by mass to 40% by mass.

The plasticizer may be used for the purpose of adjusting slidability (improvement of transportability by reducing friction), improving fixing part offset (release of toner or layer to the fixing part), adjusting curl balance, adjusting charge control (formation of a toner electrostatic image), and the like.

—Colorant—

The colorant is not particularly limited and mat be suitably selected in accordance with the intended use. Examples of colorants include fluorescent whitening agents, white pigments, colored pigments, and dyes.

The fluorescent whitening agent has absorption in the near-ultraviolet region and is a compound which emits fluorescence at 400 nm to 500 nm. Various fluorescent whitening agents known in the art may be used without any particular limitation. Examples of the fluorescent whitening agents include the compounds described in *The Chemistry of Synthetic Dyes* Volume V, Chapter 8 edited by K. VeenRataraman. The fluorescent whitening agent can be suitably synthesized for use, or those commercially available are usable. Specific examples of the fluorescent whitening agents include stilbene compounds, coumarin compounds, biphenyl compounds, benzo-oxazoline compounds, naphthalimide compounds, pyrazoline compounds, carbostyryl compounds and the like. Examples of the commercial fluorescent whitening agents include WHITEX PSN, PHR, HCS, PCS, and B (available from Sumitomo Chemicals), and UVITEX-OB (available from Ciba-Geigy, Co., Ltd.).

The white pigment is not particularly limited, and can be suitably selected from those known in the art in accordance with the intended use. Examples of the white pigments include the inorganic pigments such as titanium oxide, and calcium carbonate.

The colored pigment is not particularly limited, and can be suitably selected from those known in the art in accordance with the intended use. Examples of the colored pigments include various pigments described in JP-A No. 63-44653, azo pigments, polycyclic pigments, condensed polycyclic pigments, lake pigments, and carbon black.

Examples of the azo pigments include azo lakes (such as carmine 6B, and red 2B), insoluble azo compounds (such as monoazo yellow, disazo yellow, pyrazolo orange, and Balkan orange), condensed azo pigments (such as chromophthal yellow and chromophthal red).

Examples of the polycyclic pigments include phthalocyanines such as copper phthalocyanine blue, and copper phthalocyanine green.

Examples of the condensed polycyclic pigments include dioxazines (such as dioxazine violet), isoindolinones (such as isoindolinone yellow), threne pigments, perylene pigments, perinon pigments, and thioindigo pigments.

Examples of the lake pigments include malachite green, rhodamine B, rhodamine G, Victoria blue B and the like.

Examples of the inorganic pigments include oxide (titanium dioxide, iron oxide red and the like), sulfate (settling barium sulfate and the like), carbonate (settling calcium carbonate and the like), silicate (hydrous silicate, silicic anhydride and the like), metal powder (aluminium powder, bronze powder, zinc powder, chrome yellow, iron blue and the like) and the like.

Each of these pigments may be used alone or in combination with two or more.

The dye is not particularly limited and can be suitably selected from those known in the art in accordance with the intended use. Examples of the dyes include anthraquinone compounds, and azo compounds. These can be used either alone or in combination with two or more.

Examples of water-insoluble dyes include architecture dye, disperse dye, and oil-soluble dye.

Examples of the architecture dyes include vat dyes such as C. I. Vat violet 1, C. I. Vat violet 2, C. I. Vat violet 9, C. I. Vat violet 13, C. I. Vat violet 21, C. I. Vat blue 1, C. I. Vat blue 3, C. I. Vat blue 4, C. I. Vat blue 6, C. I. Vat blue 14, C. I. Vat blue 20, C. I. Vat blue 35 and the like. Examples of the disperse dyes include C. I. disperse violet 1, C. I. disperse violet 4, C. I. disperse violet 10, C. I. disperse blue 3, C. I. disperse blue 7, C. I. disperse blue 58 and the like. Examples of the oil-soluble dyes include C. I. solvent violet 13, C. I. solvent violet 14, C. I. solvent violet 21, C. I. solvent violet 27, C. I. solvent blue 11, C. I. solvent blue 12, C. I. solvent blue 25, and C. I. solvent blue 55.

Colored couplers used in silver halide photography may also be preferably used.

The content of the colorant in the toner image-receiving layer (surface) is preferably 0.1 $g/m^2$ to 8 $g/m^2$, and more preferably 0.5 $g/m^2$ to 5 $g/m^2$. When the content of colorant is less than 0.1 $g/m^2$, the light transmittance in the toner image-receiving layer becomes high. When it is more than 8 $g/m^2$, handling becomes more difficult, due to crack and adhesive resistance.

Among the colorants, the amount of the added pigment is, based on the mass of the thermoplastic resin constituting the toner image-receiving layer, preferably 40% by mass, more preferably 30% by mass or less, and still more preferably 20% by mass or less.

The filler may be an organic or inorganic filler. Reinforcers for binder resins, bulking agents and reinforcements known in the art may be used. The filler may be selected, referring to "Handbook of Rubber and Plastics Additives" (ed. Rubber Digest Co.), "Plastics Blending Agents—Basics and Applications" (New Edition) (Taisei Co.), "The Filler Handbook" (Taisei Co.), or the like.

As the filler, various inorganic fillers or inorganic pigments can be used suitably. Examples of inorganic fillers or inorganic pigments include silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate, and mullite. Of these, silica and alumina are particularly preferred. These may be used alone or in combination with two or more. It is preferred that the filler has a small particle diameter. When the particle diameter is large, the surface of the toner image-receiving layer tends to become rough.

Examples of the silicas include spherical silica and amorphous silica. The silica may be synthesized by the dry method, wet method or aerogel method. The surface of the hydrophobic silica particles may also be treated by trimethylsilyl groups or silicone. Colloidal silica is preferred. The silica is preferably porous.

The alumina includes anhydrous alumina and hydrated alumina. Examples of crystallized anhydrous aluminas which may be used are $\alpha$, $\beta$, $\gamma$, $\delta$, $\zeta$, $\eta$, $\theta$, $\kappa$, $\rho$, or $\chi$. Hydrated alumina is preferred to anhydrous alumina. The hydrated alumina may be a monohydrate or trihydrate. Monohydrates include pseudo-boehmite, boehmite and diaspore. Trihydrates include gibbsite and bayerite. Porous alumina is preferred.

The alumina hydrate can be synthesized by the sol-gel method, in which ammonia is added to an aluminum salt solution to precipitate alumina, or by hydrolysis of an alkali aluminate. Anhydrous alumina can be obtained by dehydrating alumina hydrate by the action of heat.

The amount of filler to be added is preferably from 5 parts by mass to 2,000 parts by mass relative to 100 parts by mass of the dry mass of the binder of the toner image-receiving layer.

A cross-linking agent can be added in order to adjust the storage stability or thermoplastic properties of the toner image-receiving layer. Examples of the cross-linking agents include compounds containing two or more reactive groups in the molecule, such as an epoxy group, an isocyanate group, an aldehyde group, an active halogen group, an active methylene group, an acetylene group and other reactive groups known in the art.

The cross-linking agent may also be a compound having two or more groups capable of forming bonds such as hydrogen bonds, ionic bonds, coordinate bonds, or the like.

Examples of the cross-linking agents include a coupling agent for resin, curing agent, polymerizing agent, polymerization promoter, coagulant, film-forming agent, film-forming assistant, or the like. Examples of the coupling agents include chlorosilanes, vinylsilanes, epoxysilanes, aminosilanes, alkoxyaluminum chelates, and titanate coupling agents. The examples further include other agents known in the art such as those mentioned in *Binran—Gomu purasuchikkusu no haigou yakuhin* "Handbook of Rubber and Plastics Additives" (ed. Rubber Digest Co.).

The charge control agent is preferably added to adjust toner transfer, adhesion or the like to the toner image-receiving layer, and to prevent charge adhesion of the toner image-receiving layer.

The charge control agent is not particularly limited and may be any charge control agent known in the art. Examples of the charge control agents include surfactants such as a cationic surfactant, an anionic surfactant, an amphoteric surfactant, a nonionic surfactant, or the like; polymer electrolytes, and conductive metal oxides. Examples thereof include cationic charge inhibitors such as quaternary ammonium salts, polyamine derivatives, cation-modified polymethylmethacrylate, and cation-modified polystyrene; and anionic charge inhibitors such as alkyl phosphates, anionic polymers, or the like; and nonionic charge inhibitors such as aliphatic ester, polyethylene oxide, or the like. The examples are not limited thereto, however.

When the toner has a negative charge, it is preferred that the charge control agent blended with the toner image-receiving layer is, for example, cationic or nonionic.

Examples of the conductive metal oxides include ZnO, $TiO_2$, $SnO_2$, $Al_2O_3$, $In_2O_3$, $SiO_2$, MgO, BaO, $MoO_3$. These conductive metal oxides may be used alone or may be used in combination with two or more. Moreover, the conductive metal oxide may contain (dope) other elements. For example, ZnO may contain Al, In, or the like, $TiO_2$ may contain Nb, Ta, or the like, and $SnO_2$ may contain Sb, Nb, halogen elements, or the like.

—Other Additives—

The materials used for the toner image-receiving layer may also contain various additives to improve image stability of the output image or to improve stability of the toner image-receiving layer itself. Examples of the additives include various known antioxidants, age resistors, degradation inhibitors, ozone degradation inhibitors, ultraviolet ray absorbers, metal complexes, light stabilizers, preservatives, and fungicide.

The antioxidant is not particularly limited and may be suitably selected in accordance with the intended use. Examples of the antioxidants include chroman compounds, coumarane compounds, phenol compounds (for example, hindered phenols), hydroquinone derivatives, hindered amine derivatives, spiroindan compounds and the like. The antioxidants can be found in JP-A No. 61-159644.

Examples of age resistors include those found in *Binran—Gomu purasuchikku haigou yakuhin—kaitei dai* 2 *han* "Handbook of Rubber and Plastics Additives, Second Edition" (1993, Rubber Digest Co.), pp. 76-121.

The ultraviolet ray absorber is not particularly limited, and can be suitably selected in accordance with the intended use. Examples of the ultraviolet ray absorbers include benzotriazol compounds (described in the U.S. Pat. No. 3,533,794), 4-thiazolidone compounds (described in the U.S. Pat. No. 3,352,681), benzophenone compounds (described in JP-A No. 46-2784), ultraviolet ray absorbing polymers (described in JP-A No. 62-260152).

The metal complex is not particularly limited and may be suitably selected in accordance with the intended use. Examples of the metal complexes include those described in U.S. Pat. Nos. 4,241,155, 4,245,018, 4,254,195, JP-A Nos. 61-88256, 62-174741, 63-199248, 01-75568, 01-74272 and the like.

The ultraviolet ray absorbers and light stabilizers found in *Binran—Gomu purasuchikku haigou yakuhin—kaitei dai* 2 *han* "Handbook of Rubber and Plastics Additives, Second Edition" (1993, Rubber Digest Co.), pp. 12-137 are preferably used.

Additives for photography known in the art may also be added to the material used for the toner image-receiving layer as described above. Examples of the photographic additives can be found in the Journal of Research Disclosure (hereinafter referred to as RD) No. 17643 (December 1978), No. 18716 (November 1979) and No. 307105 (November 1989). The relevant sections are shown below.

TABLE 1

| | RD17643 | RD18716 | RD307105 |
|---|---|---|---|
| Type of additive | | | |
| 1. Whitener | p.24 | p.648 right column | p.868 |
| 2. Stabilizer | pp.24-25 | p.649 right column | pp.868-870 |
| 3. Light absorber (Ultraviolet ray absorber) | pp.25-26 | p.649 right column | pp.873 |
| 4. Colorant image stabilizer | p.25 | p.650 right column | p.872 |
| 5. Film hardener | p.26 | p.651 left column | p.874-875 |
| 6. Binder | p.26 | p.651 left column | p.873-874 |
| 7. Plasticizer, lubricant | p.27 | p.650 right column | p.876 |
| 8. Auxiliary application agent (Surfactant) | pp.26-27 | p.650 right column | pp.875-876 |
| 9. Antistatic agent | p.27 | p.650 right column | p.876-877 |
| 10. Matting agent | — | — | pp.878-879 |

The toner image-receiving layer under the present invention is formed by applying with a wire coater and the like the coating solution (containing thermoplastic resin for the toner image-receiving layer) to the support and by drying it. The minimum film-forming temperature (MFT) of the thermoplastic resin under the present invention is preferably the room temperature or higher, from the viewpoint of pre-print storage, and preferably 100° C. or lower, from the viewpoint of fixing toner particles.

The toner image-receiving layer under the present invention preferably has an application mass after drying in a range from 1 g/cm$^2$ to 20 g/cm$^2$, more preferably 4 g/cm$^2$ to 15 g/cm$^2$.

The thickness of the toner image-receiving layer is not particularly limited and may be suitably selected in accordance with the intended use. For example, the thickness is preferably from 1 μm to 50 μm, more preferably from 1 μm to 30 μm, still more preferably 2 μm to 20 μm, and particularly preferably 5 μm to 15 μm.

[Other Layers]

Other layers of the toner image-receiving layer may include, for example, a surface protective layer, back layer, intermediate layer, contact improving layer, cushion layer, intermediate layer, charge control (inhibiting) layer, reflecting layer, tint adjusting layer, preservability improving layer, anti-adhering layer, anti-curl layer, smoothing layer and the like. These layers may have a single-layer structure or may be formed of two or more layers.

The surface protective layer may be formed on the surface of the toner image-receiving layer for the purpose of protecting the surface, improving preservability, improving handling property, giving writing property, improving machine passing property, giving antioffset property and the like of the electrophotographic image-receiving paper sheet. The surface protective layer may have a single-layer structure or may be formed of two or more layers. As a binder, various kinds of thermoplastic resins, thermosetting resins and the like may be used for the surface protective layer. Resins of the binder and the toner image-receiving layer are preferably of the same kind. In this case, however, the surface protective layer and the toner image-receiving layer do not need to be the same in terms of thermodynamic property, electrostatic property and the like. Those properties can be optimized.

The surface protective layer can be blended with the particles as a matting agent contained in the toner image-receiving layer. In addition, the surface protective layer can be blended with various additives described above that are usable for the toner image-receiving layer. Particularly, the surface protective layer can be blended with the releasing agent used under the present invention, and other additives such as matting agent and the like. Various known matting agents are named.

The top surface layer of the electrophotographic image-receiving paper sheet (for example, the surface protective layer when formed) is preferred to have compatibility with the toner in terms of fixation property. Specifically, the top surface layer preferably has a contact angle with the melted toner in a range from 0° to 40°.

The back layer of the electrophotographic image-receiving paper sheet is preferably formed on an opposite side of the toner image-receiving layer with respect to the support, for the purpose of giving a backface output property, improving output image quality of the backface, improving curl balance, improving machine passing property and the like.

Color of the back layer is not particularly limited. In the case of both-side output type image-receiving paper sheet forming the image also on the backface, however, the color of the back layer is also preferred to be white. Like the surface, the back layer is preferred to have whiteness of 85% or more and spectral reflectance of 85% or more.

Moreover, for improving both-side output property, the back layer may have a structure same as that of the toner image-receiving layer side. The back layer may use the various kinds of additives as explained above. Examples of the blended additives include matting agent, charge control agent and the like. The back layer may have a single-layer structure or may be formed of two or more layers.

When a mold-releasing oil is used for a fixing roller and the like for preventing offset during the fixing, the back layer may have oil absorbing property.

In the electrophotographic image-receiving paper sheet, the above contact improving layer is preferred to be formed for improving the contact of the support and the toner image-receiving layer. The contact improving layer may be blended with various additives described above, particularly the cross-linking agent.

Moreover, the electrophotographic image-receiving paper sheet is preferred to have a cushion layer and the like between the contact improving layer and the toner image-receiving layer, for improving receptivity of the toner.

The intermediate layer may be formed, for example, between the support and the contact improving layer, between the contact improving layer and the cushion layer, between the cushion layer and the toner image-receiving layer, between the toner image-receiving layer and the preservability improving layer and the like. In the case of the electrophotographic image-receiving paper sheet that is formed with the support, the toner image-receiving layer, and the intermediate layer, the intermediate layer can be formed, for example, between the support and the toner image-receiving layer.

The intermediate layer is preferably the resin coat layer. The resin coat layer as the intermediate layer contains at least a polymer for the intermediate layer and further contains other various components in accordance with the necessity.

The polymer for the intermediate layer is not particularly limited and may be suitably selected as long as the polymer is suitably usable for the coating solution. For example, resins similar to the polymer for the toner image-receiving layer can be used. Among them, the water-soluble polymer, the water-dispersible polymer or the like can be preferably used, and the self-dispersible waterborne polyester emulsion, or water dispersible acrylic resin is more preferably used. Examples of the polymer for the intermediate layer include those describe those satisfying the physical properties disclosed in Japanese Patent Application Laid-Open (JP-A) Nos. 05-127413, 08-194394, 08-334915, 08-334916, 09-171265, and 10-221877. The content of the polymer for the intermediate layer in the intermediate layer based on the mass of the inter mediate layer is preferably 20% by mass or more, and more preferably 30% by mass to 100% by mass.

The polymer for the intermediate layer is not particularly limited and may be blended with the various components mentioned in the toner image-receiving layer as long as the functions of the intermediate layer are not impaired.

The intermediate layer can be prepared, for example, by preparing a coating solution for the intermediate layer and applying the coating solution. The use of the coating solution for the intermediate layer makes it possible to prepare the intermediate layer relatively readily on the support and also makes it possible to accelerate infiltration of the polymer for the intermediate layer in the thickness direction of the support.

—Heat-Sensitive Material—

The heat sensitive material has, for example, the image recording material support of the present invention, and at least one heat-coloring layer, as the image-recording layer, disposed on at least one surface of the image-recording material support. Examples thereof include, but are not limited to, heat sensitive material and the like used in thermo-autochrome method (TA method) in which a repetition of heating by a heat sensitive head and fixing by ultraviolet light forms an image.

—Sublimation Transfer Material—

The sublimation transfer material has, for example, at least the image-recording material support of the present invention, and at least one ink layer containing a heat-diffusion pigment (subliming pigment), as the image recording layer, disposed on at least one surface of the image-recording material support. It is generally used in, for example, a sublimation transfer method in which a heat sensitive head heats an ink layer so as to transfer the heat-diffusion pigment to a sublimation transfer sheet.

—Heat Transfer Material—

The heat transfer material has, for example, the image-recording material support of the present invention and at least one heat-melting ink layer as, as the image-recording layer, disposed on at least one surface of the image-recording material support. It is generally used in, for example, a method in which a heat sensitive head heats the heat-melting ink layer so as to melt and transfer the ink to a heat transfer sheet.

—Silver Salt Photographic Material—

The silver salt photographic material has, for example, the image-recording material support of the present invention and at least one image-recording layer which develops at least yellow, magenta, and cyan (YMC), as the above-noted image recording layer, disposed on the image-recording material support. It is generally used in, for example, silver halide photography in which an exposed and printed silver halide photographic sheet is soaked in several treatment baths one after another so as to perform color developing, bleaching and fixing, washing with water, and drying.

—Inkjet-Recording Material—

The inkjet-recording material includes, for example, an inkjet-recording material having the image-recording layer under the present invention and at least one colorant-receiving layer, as the image recording layer, disposed on at least one surface of the image-recording material support, where the colorant-receiving layer is capable of receiving a liquid ink such as an aqueous ink (using a pigment or dye as the colorant), an oil ink and the like; a solid ink which is solid at room temperature and which is melted and liquefied when used for a print; and is used for an inkjet recording method in which the inkjet-recording material is spray-dropped to make it adhere on a recording material such as paper, thereby forming dots on the recording material.

EXAMPLES

Hereafter, the present invention will be further described in detail referring to specific Examples and Comparative Examples, however, the present invention is not limited to the disclosed Examples.

Example 1

Preparation of Image Recording Material Support

Preparation of Paper

First, acasia was beaten to a Canadian Standard Freeness (C. S. F.) of 330 mL using a refiner equipped with beating plates each having the average blade angle of zero degrees (radiating angle) while positively rotating and reversely rotating the beating plate alternately at every 10,000,000 revolutions to thereby prepare a pulp sample of which the content ratio of long fiber pulp having a fiber length of 0.7 mm or more was 12% relative to the entire pulp content.

Thereafter, to the pulp paper material, 1.5% by mass of cation starch based on the pulp mass was added. The obtained pulp paper material was treated with a manual paper-making machine to make wet paper having an absolute dry weight of 140 g/m$^2$ and water content of 68%.

Both sides of the wet paper thus obtained were covered with filter paper and dehydrated using a wet press apparatus to adjust water content to 47%.

The dehydrated wet paper was then dried with a cylinder dryer to prepare paper. Thereafter, the obtained paper was subjected to a calender treatment using a soft calender apparatus under the conditions where the surface temperature of a metal roller was set at 250° C. for a surface (right face) of the paper to be formed with an image recording layer, and the surface temperature of a resin roller was set at 40° C. for the opposite surface (back face) on which the an image recording was to be formed, thereby paper was produced. For the obtained paper, the average fiber length of pulp measured as stated below was 0.63 mm.

<Measurement of Average Fiber Length of Pulp>

First, a 4 cm×4 cm paper matrix was soaked in 80 cm$^3$ of a sodium hydroxide aqueous solution defined as 1.0 for 3 days and then the paper matrix was sufficiently washed with water. Next, pure water was added to the adequately washed paper matrix with water so as to be a slurry of 3% by mass pure water, and the paper matrix was defiberized using a dispersing unit so as not to cut off pulp fibers to thereby obtain a pulp slurry. The obtained pulp slurry was measured as to the length-weighted average fiber length in conformity to the JAPAN TAPPI Paper Pulp Testing Method No. 52-89 of "Testing method for length of paper and pulp fibers. The measured length-weighted average fiber length (mm) was taken as the average fiber length of the pulp.

A juicer mixer having rounded blades configured not to cut off fibers was used, and pulp fibers were stirred for 20 minutes.

—Formation of Polymer Coat Layer—

Next, on the right-face of the obtained paper, low density polyethylene and high density polyethylene at a mass ratio of (LDPE)/(HDPE)=7/3 were melted and extruded so as to have a thickness of 30 μm to form a right face polymer coating layer.

In the meanwhile, on the back face of the paper, low density polyethylene and high density polyethylene at a mass ratio of (LDPE)/(HDPE)=3/7 were melted and extruded so as to have a thickness of 25 μm to thereby form a back face polymer coat layer. With the above-noted process steps, an image recording material support of Example 1 was prepared.

Example 2

Preparation of Image Recording Material Support

Paper of Example 2 was produced in the same manner as in Example 1 except that acasia was beaten to a Canadian Standard Freeness (C. S. F.) of 350 mL using a refiner equipped with beating plates each having the average blade angle of zero degrees (radiating angle) while positively rotating and reversely rotating the beating plate alternately at every 10,000,000 revolutions to thereby prepare a pulp sample of which the content ratio of long fiber pulp having a fiber length of 0.7 mm or more was 13% relative to the entire pulp content. For the obtained paper, the average fiber length of pulp measured in the same manner as in Example 1 was 0.65 mm.

On the right face and the back face of the obtained paper respectively, a polymer coat layer was provided in the same manner as in Example 1, thereby an image recording material support of Example 2 was prepared.

Example 3

Preparation of Image Recording Material Support

Paper of Example 3 was produced in the same manner as in Example 1 except that acasia was beaten to a Canadian Standard Freeness (C. S. F.) of 310 mL using a refiner equipped with beating plates each having the average blade angle of 4 degrees (radiating angle) while positively rotating and reversely rotating the beating plate alternately at every 10,000,000 revolutions to thereby prepare a pulp sample of which the content ratio of long fiber pulp having a fiber length of 0.7 mm or more was 9% relative to the entire pulp content. For the obtained paper, the average fiber length of pulp measured in the same manner as in Example 1 was 0.62 mm.

On the right face and the back face of the obtained paper respectively, a polymer coat layer was provided in the same manner as in Example 1, thereby an image recording material support of Example 3 was prepared.

Example 4

Preparation of Image Recording Material Support

Paper of Example 4 was produced in the same manner as in Example 1 except that acacia/aspen (mass ratio=1/1) were beaten to a Canadian Standard Freeness (C. S. F.) of 380 mL using a refiner equipped with beating plates each having the average blade angle of 6 degrees (radiating angle) while positively rotating and reversely rotating the beating plate alternately at every 10,000,000 revolutions to thereby prepare a pulp sample of which the content ratio of long fiber pulp having a fiber length of 0.7 mm or more was 15% relative to the entire pulp content. For the obtained paper, the average fiber length of pulp measured in the same manner as in Example 1 was 0.68 mm.

On the right face and the back face of the obtained paper respectively, a polymer coat layer was provided in the same manner as in Example 1, thereby an image recording material support of Example 4 was prepared.

Example 5

Preparation of Image Recording Material Support

Paper of Example 5 was produced in the same manner as in Example 1 except that aspen was beaten to a Canadian Standard Freeness (C. S. F.) of 370 mL using a refiner equipped with beating plates each having the average blade angle of 6 degrees (radiating angle) without reversely rotating the beating plates at every 10,000,000 revolutions to thereby prepare a pulp sample of which the content ratio of long fiber pulp having a fiber length of 0.7 mm or more was 19% relative to the entire pulp content. For the obtained paper, the average fiber length of pulp measured in the same manner as in Example 1 was 0.71 mm.

On the right face and the back face of the obtained paper respectively, a polymer coat layer was provided in the same manner as in Example 1, thereby an image recording material support of Example 5 was prepared.

Example 6

Preparation of Image Recording Material Support

Paper of Example 6 was produced in the same manner as in Example 1 except that acasia was beaten to a Canadian Standard Freeness (C. S. F.) of 350 mL using a refiner equipped with beating plates each having the average blade angle of 8 degrees as shown in FIGS. 1A and 1B while positively rotating and reversely rotating the beating plate alternately at every 10,000,000 revolutions to thereby prepare a pulp sample of which the content ratio of long fiber pulp having a fiber length of 0.7 mm or more was 14% relative to the entire pulp content. For the obtained paper, the average fiber length of pulp measured in the same manner as in Example 1 was 0.66 mm.

On the right face and the back face of the obtained paper respectively, a polymer coat layer was provided in the same manner as in Example 1, thereby an image recording material support of Example 6 was prepared.

Example 7

Preparation of Image Recording Material Support

Paper of Example 7 was produced in the same manner as in Example 1 except that maple was beaten to a Canadian Standard Freeness (C. S. F.) of 290 mL using a refiner equipped with beating plates each having the average blade angle of 8 degrees as shown in FIGS. 1A and 1B while positively rotating and reversely rotating the beating plate alternately at every 10,000,000 revolutions to thereby prepare a pulp sample of which the content ratio of long fiber pulp having a fiber length of 0.7 mm or more was 8% relative to the entire pulp content. For the obtained paper, the average fiber length of pulp measured in the same manner as in Example 1 was 0.57 mm.

On the right face and the back face of the obtained paper respectively, a polymer coat layer was provided in the same manner as in Example 1, thereby an image recording material support of Example 7 was prepared.

Example 8

Preparation of Image Recording Material Support

Paper of Example 8 was produced in the same manner as in Example 1 except that maple/aspen (mass ratio=1/2) were beaten to a Canadian Standard Freeness (C. S. F.) of 280 mL using a refiner equipped with beating plates each having the average blade angle of 12 degrees (radiating angle) while positively rotating and reversely rotating the beating plate alternately at every 10,000,000 revolutions to thereby prepare a pulp sample of which the content ratio of long fiber pulp having a fiber length of 0.7 mm or more was 18% relative to the entire pulp content. For the obtained paper, the average fiber length of pulp measured in the same manner as in Example 1 was 0.65 mm.

On the right face and the back face of the obtained paper respectively, a polymer coat layer was provided in the same manner as in Example 1, thereby an image recording material support of Example 8 was prepared.

Comparative Example 1

Preparation of Image Recording Material Support

Paper of Comparative Example 1 was produced in the same manner as in Example 1 except that acasia was beaten to a Canadian Standard Freeness (C. S. F.) of 480 mL using a refiner equipped with beating plates each having the average blade angle of 8 degrees while positively rotating and reversely rotating the beating plate alternately at every 10,000,000 revolutions to thereby prepare a pulp sample of which the content ratio of long fiber pulp having a fiber length of 0.7 mm or more was 26% relative to the entire pulp content. For the obtained paper, the average fiber length of pulp measured in the same manner as in Example 1 was 0.78 mm.

On the right face and the back face of the obtained paper respectively, a polymer coat layer was provided in the same manner as in Example 1, thereby an image recording material support of Comparative Example 1 was prepared.

Comparative Example 2

Preparation of Image Recording Material Support

Paper of Comparative Example 2 was produced in the same manner as in Example 1 except that poplar was beaten to a Canadian Standard Freeness (C. S. F.) of 450 mL using a refiner equipped with beating plates each having the average blade angle of 8 degrees without reversely rotating the beating plates at every 10,000,000 revolutions to thereby prepare a pulp sample of which the content ratio of long fiber pulp having a fiber length of 0.7 mm or more was 31% relative to the entire pulp content. For the obtained paper, the average fiber length of pulp measured in the same manner as in Example 1 was 0.74 mm.

On the right face and the back face of the obtained paper respectively, a polymer coat layer was provided in the same manner as in Example 1, thereby an image recording material support of Comparative Example 2 was prepared.

Comparative Example 3

Preparation of Image Recording Material Support

Paper of Comparative Example 3 was produced in the same manner as in Example 1 except that poplar/aspen (mass ratio=1/2) were beaten to a Canadian Standard Freeness (C. S. F.) of 350 mL using a refiner equipped with beating plates each having the average blade angle of 14 degrees (radiating angle) while positively rotating and reversely rotating the beating plate alternately at every 10,000,000 revolutions to thereby prepare a pulp sample of which the content ratio of long fiber pulp having a fiber length of 0.7 mm or more was 23% relative to the entire pulp content. For the obtained paper, the average fiber length of pulp measured in the same manner as in Example 1 was 0.69 mm.

On the right face and the back face of the obtained paper respectively, a polymer coat layer was provided in the same manner as in Example 1, thereby an image recording material support of Comparative Example 3 was prepared.

Comparative Example 4

Preparation of Image Recording Material Support

Paper of Comparative Example 4 was produced in the same manner as in Example 1 except that aspen was beaten to a Canadian Standard Freeness (C. S. F.) of 310 mL using a refiner equipped with beating plates each having the average blade angle of 18 degrees without reversely rotating the beating plates at every 10,000,000 revolutions to thereby prepare a pulp sample of which the content ratio of long fiber pulp having a fiber length of 0.7 mm or more was 24% relative to the entire pulp content. For the obtained paper, the average fiber length of pulp measured in the same manner as in Example 1 was 0.71 mm.

On the right face and the back face of the obtained paper respectively, a polymer coat layer was provided in the same manner as in Example 1, thereby an image recording material support of Comparative Example 4 was prepared.

Comparative Example 5

Preparation of Image Recording Material Support

Paper of Comparative Example 5 was produced in the same manner as in Example 1 except that poplar/acasia (mass ratio=1/2) were beaten to a Canadian Standard Freeness (C. S. F.) of 270 mL using a refiner equipped with beating plates each having the average blade angle of 12 degrees (radiating angle) without reversely rotating the beating plates at every 10,000,000 revolutions to thereby prepare a pulp sample of which the content ratio of long fiber pulp having a fiber length of 0.7 mm or more was 21% relative to the entire pulp content. For the obtained paper, the average fiber length of pulp measured in the same manner as in Example 1 was 0.66 mm.

On the right face and the back face of the obtained paper respectively, a polymer coat layer was provided in the same manner as in Example 1, thereby an image recording material support of Comparative Example 5 was prepared.

TABLE 2

| | Pulp Preparation Method | | | | | |
|---|---|---|---|---|---|---|
| | Pulp | Blade angle | Rotational direction | Freeness | Average fiber length | Content ratio of long fibers |
| Ex. 1 | acasia | 0° | Changed | 330 mL | 0.63 mm | 12% |
| Ex. 2 | acasia | 0° | Changed | 350 mL | 0.65 mm | 13% |
| Ex. 3 | acasia | 4° | Changed | 310 mL | 0.62 mm | 9% |
| Ex. 4 | acasia/aspen = 1/1 | 6° | Changed | 380 mL | 0.68 mm | 15% |
| Ex. 5 | aspen | 6° | Not changed | 370 mL | 0.71 mm | 19% |
| Ex. 6 | acasia | 8° | Changed | 350 mL | 0.66 mm | 14% |
| Ex. 7 | maple | 8° | Changed | 290 mL | 0.57 mm | 8% |
| Ex. 8 | maple/aspen = 1/2 | 12° | Changed | 280 mL | 0.65 mm | 18% |
| Compara. Ex. 1 | acasia | 8° | Changed | 480 mL | 0.78 mm | 26% |
| Compara. Ex. 2 | poplar | 8° | Not changed | 450 mL | 0.74 mm | 31% |
| Compara. Ex. 3 | maple/aspen = 1/2 | 14° | Not changed | 350 mL | 0.69 mm | 23% |
| Compara. Ex. 4 | aspen | 18° | Not changed | 310 mL | 0.71 mm | 24% |
| Compara. Ex. 5 | maple/acasia = 1/2 | 12° | Not changed | 270 mL | 0.66 mm | 21% |

* Blade angle: The radial angle was set to 0°
* Rotational direction: The rotational direction of beating plates after 10,000,000 revolutions Next, each of the image recording material supports prepared in Examples 1 to 8 and Comparative Examples 1 to 5 was evaluated as to planarity, glossiness, and rigidity in the manner as described below. Table 3 shows the evaluation results.

<Planality>

Twenty graders visually checked and evaluated the each of the obtained image recording material supports as to planality to rank them based on the following criteria. An image recording material support evaluated as the most excellent in planality (wavelength of 5 mm to 6 mm) was ranked as A, and subsequently evaluated image recording material supports were respectively ranked as B, C, D, or E.

[Evaluation Criteria]

A: Very excellent
B: Excellent
C: Passable
D: Degraded
E: Considerably degraded

<Evaluation of Rigidity>

The twenty graders touched and evaluated the each of the obtained image recording material supports as to stiffness (rigidity) to rank them based on the following criteria.

[Evaluation Criteria]

A . . . No problem with rigidity at all
B . . . No problem with rigidity
C . . . The rigidity was slightly degraded, which was on a level where it would not be problematic practically.
D . . . The rigidity was insufficient, which was on a level where it would be problematic practically.
E . . . Did not have rigidity (stiffness).

<Evaluation of Glossiness>

The twenty graders visually checked and evaluated the each of the obtained image recording material supports as to glossiness to rank them based on the following criteria. An image recording material support evaluated as the most excellent in glossiness was ranked as A, and subsequently evaluated image recording material supports were respectively ranked as B, C, D, or E.

[Evaluation Criteria]

A: Very excellent
B: Excellent
C: Passable
D: Degraded
E: Considerably degraded

TABLE 3

| | Properties of Support | | |
|---|---|---|---|
| | Planality (wavelength 5 mm to 6 mm) | Glossiness | Rigidity |
| Ex. 1 | A | A | A |
| Ex. 2 | A | A | A |
| Ex. 3 | A | A | A |
| Ex. 4 | B | A | B |
| Ex. 5 | B | B | A |
| Ex. 6 | A | A | A |
| Ex. 7 | A | A | B |
| Ex. 8 | B | A | A |
| Compara. Ex. 1 | D | C | C |
| Compara. Ex. 2 | E | D | C |
| Compara. Ex. 3 | C | B | A |
| Compara. Ex. 4 | C | C | A |
| Compara. Ex. 5 | C | B | A |

The results shown in Table 3 demonstrated that the each of the image recording material supports of Examples 1 to 8 was excellent in any of planality, rigidity, and glossiness as compared to the image recording material supports of Comparative Examples 1 to 5.

Example 9

Preparation of Electrophotographic Material

An electrophotographic material of Example 9 was prepared as the image recording material under the present invention by the following method, using the image recording material support of Example 1.

—Titanium Dioxide Fluid Dispersion—

In a vessel, 40.0 g of titanium dioxide (Tipaque (Registered) A-220, available from ISHIHARA INDUSTRY CO., LTD.), 2.0 g of PVA102 (available from KURARAY Co., Ltd.), and 58.0 g of ion exchange water were mixed, and dispersed using NBK-2 available from Nippon Seiki Co., Ltd. to thereby prepare a titanium dioxide fluid dispersion (having a content of titanium dioxide pigment of 40% by mass).

—Preparation of Coating Solution for Toner Image-Receiving Layer—

In a vessel, 15.5 g of the titanium dioxide fluid dispersion, 15.0 g of carnauba wax water dispersion (Cellozole 524, available from Chukyo Yushi Co., Ltd.), 100.0 g of polyester resin water dispersion (KZA-7049, available from UNITIKA Ltd.; solid content: 30% by mass), 2.0 g of thickening agent (Alcox E30, available from Meisei Chemicals Co., Ltd.), 0.5 g of anionic surfactant (AOT), and 80 mL of ion exchange water were mixed and stirred to prepare a coating solution for a toner image-receiving layer.

The obtained coating solution for a toner image-receiving layer had a viscosity of 40 mpa·s and a surface tension of 34 mN/m.

—Preparation of Coating Solution for Back Layer—

The following components were mixed and stirred to prepared a coating solution for a back layer.

Namely, 100.0 g of acrylic resin water dispersion (Hyros XBH-997L, available from SEIKO PMC CORPORATION; solid content: 30% by mass), 5.0 g of matting agent (Technopolymer MBX-12, available from SEKISUI PLASTICS CO., LTD.), 10.0 g of releasing agent (Hydrine D337, available from Chukyo Oils), 2.0 g of thickening agent (CMC), 0.5 g of anionic surfactant (AOT), and 80 mL of ion exchange water were mixed and stirred to thereby prepare a coating solution for a back layer.

The obtained coating solution for a back layer had a viscosity of 35 mPa·s and a surface tension of 33 mN/m.

—Formation of Back Layer and Toner Image-Receiving Layer—

Over the back face of the image recording material support (the surface without a toner image-receiving provided thereon) of Example 1, the coating solution for a back layer was applied using a bar coater such that the dry mass was 9 g/m$^2$, thereby a toner image-receiving layer was formed. In the meanwhile, over the right face of the image recording material support, the coating solution for a toner image-receiving layer was applied using a bar coater such that the dry mass was 12 g/m$^2$, thereby a toner image-receiving layer was formed. The content of pigments in the toner image-receiving layer was 5% by mass relative to the content of thermoplastic resin.

After application of the coating solutions, the back layer and the toner image-receiving layer were dried by online hot air. In the drying treatment, the dry air flow and temperature were controlled such that both of the back layer and the toner image-receiving layer were fully dried within 2 minutes after application of the coating solutions. The drying point was set such that the coated surface temperature was as high as the wet-bulb temperature of dry air.

Next, after the drying treatment, the toner-image-receiving layer was subjected to a calender treatment. The calender treatment was carried out using a gloss calender under the condition of nip pressure of 14.7 kN/m$^2$ in a state where the temperature of metal roller was kept at 40° C.

The obtained electrophotographic material was cut off in A4 size to prepare an electrophotographic material of Example 9.

Example 10

Preparation of Electrophotographic Material

An electrophotographic material of Example 10 was prepared in the same manner as in Example 9 except that the image recording material support of Example 2 was used.

Example 11

Preparation of Electrophotographic Material

An electrophotographic material of Example 11 was prepared in the same manner as in Example 9 except that the image recording material support of Example 3 was used.

Example 12

Preparation of Electrophotographic Material

An electrophotographic material of Example 12 was prepared in the same manner as in Example 9 except that the image recording material support of Example 4 was used.

Example 13

Preparation of Electrophotographic Material

An electrophotographic material of Example 13 was prepared in the same manner as in Example 9 except that the image recording material support of Example 5 was used.

Example 14

Preparation of Electrophotographic Material

An electrophotographic material of Example 14 was prepared in the same manner as in Example 9 except that the image recording material support of Example 6 was used.

Example 15

Preparation of Electrophotographic Material

An electrophotographic material of Example 15 was prepared in the same manner as in Example 9 except that the image recording material support of Example 7 was used.

Example 16

Preparation of Electrophotographic Material

An electrophotographic material of Example 16 was prepared in the same manner as in Example 9 except that the image recording material support of Example 8 was used.

Comparative Example 6

Preparation of Electrophotographic Material

An electrophotographic material of Comparative Example 6 was prepared in the same manner as in Example 9 except that the image recording material support of Comparative Example 1 was used.

Comparative Example 7

Preparation of Electrophotographic Material

An electrophotographic material of Comparative Example 7 was prepared in the same manner as in Example 9 except that the image recording material support of Comparative Example 2 was used.

Comparative Example 8

Preparation of Electrophotographic Material

An electrophotographic material of Comparative Example 8 was prepared in the same manner as in Example 9 except that the image recording material support of Comparative Example 3 was used.

Comparative Example 9

Preparation of Electrophotographic Material

An electrophotographic material of Comparative Example 9 was prepared in the same manner as in Example 9 except that the image recording material support of Comparative Example 4 was used.

Comparative Example 10

Preparation of Electrophotographic Material

An electrophotographic material of Comparative Example 10 was prepared in the same manner as in Example 9 except that the image recording material support of Comparative Example 5 was used.

Next, an image was printed on the each of the electrophotographic materials of Examples 9 to 15 and Comparative Examples 6 to 10 using a printer (image forming apparatus) respectively to produce each electrophotographic print.

Figure 2:
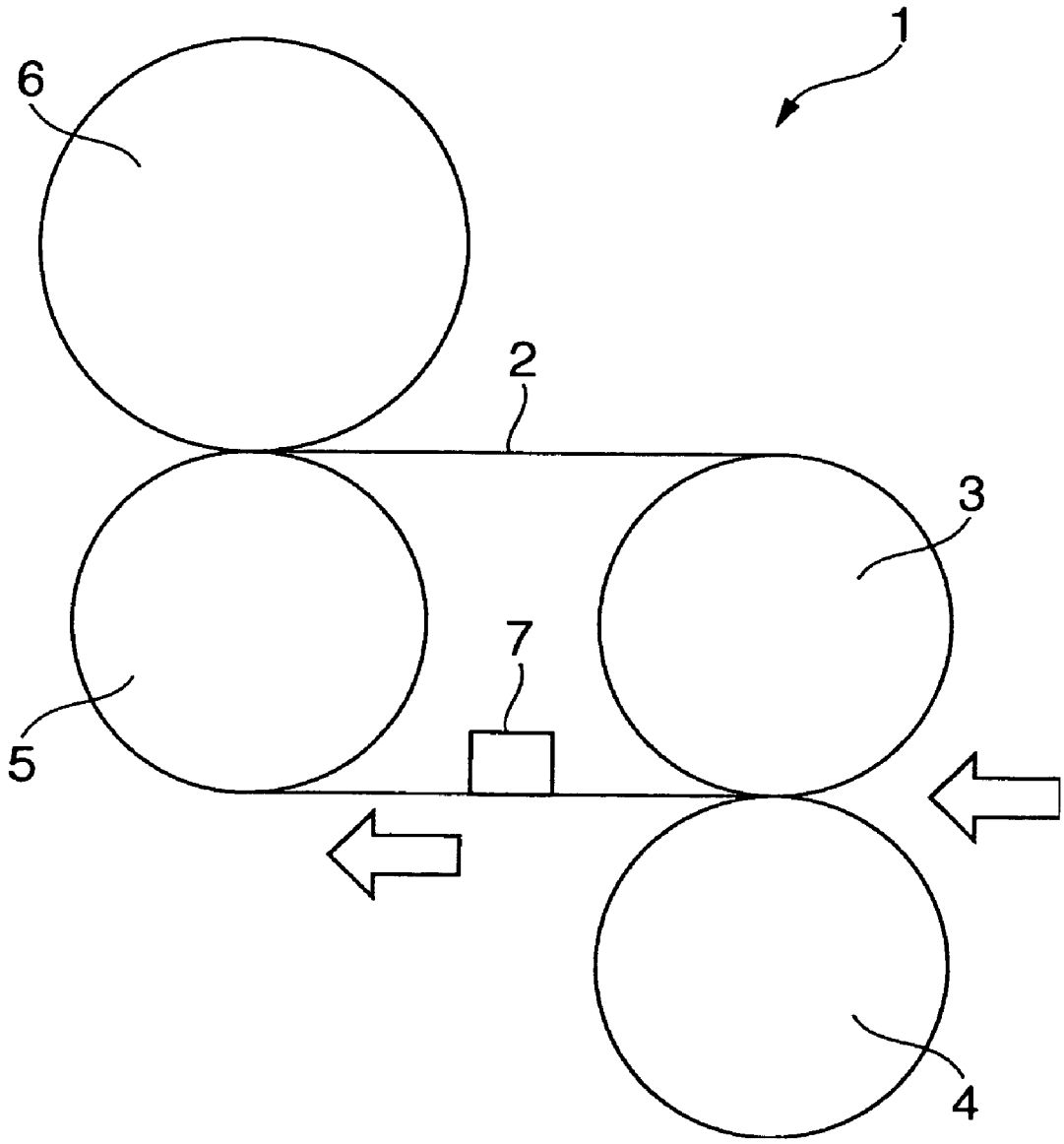
FIG. 2 is a schematic of a belt-fixing unit in the image forming apparatus or printer used in Examples of the present invention.

For the printer used in the test, a color laser printer (DocuColor 1250-PE) manufactured by FUJI XEROX Co., Ltd., equipped with a belt fixing apparatus 1 shown in FIG. 2 as the fixing part, was used.

Specifically, in the fixing belt apparatus 1 as shown in FIG. 2, a fixing belt 2 is suspended around a heating roller 3 and a tension roller 5. A cleaning roller 6 is provided via the fixing belt 2 above the tension roller 5, and a pressurizing roller 4 is further provided via the fixing belt 2 below the heating roller 3. In FIG. 2, starting from the right-hand side, the electrophotographic material carrying a toner latent image was introduced between the heating roller 3 and the pressurizing roller 4, was fixed and then transported on the fixing belt 2. In this process, the electrophotographic material was cooled by a cooling device 7, and the fixing belt 2 was finally cleaned by a cleaning roller 6.

In the fixing belt apparatus 1, the transport speed at the fixing belt 2 is 30 mm/sec, the nip pressure between the heating roller 3 and the pressurizing roller 4 was 0.2 MPa (2 kgf/cm$^2$), and the temperature of the heating roller 3 was 150° C. which corresponded to the fixing temperature. The temperature of the pressurizing roller 4 was set at 120° C.

Next, the each of the obtained photographic prints were evaluated as to image quality and glossiness in the following manner. Table 4 shows the evaluation results.

<Evaluation of Image Quality>

The image quality of the each electrophotographic prints was visually checked and evaluated based on the following criteria. An electrophotographic print evaluated as the most excellent in image quality was ranked as A, and subsequently evaluated electrophotographic prints were respectively ranked as B, C, D, or E.

[Evaluation Criteria]

A: Very excellent (effectively utilizable as a high-quality image recording material)

B: Excellent (effectively utilizable as a high-quality image recording material)

C: Passable

D: Degraded (Not utilizable as a high-quality image recording material)

E: Considerably degraded (Not utilizable as a high-quality image recording material)

<Glossiness>

The glossiness of the each of the electrophotographic prints was visually checked and evaluated based on the following criteria. An electrophotographic print evaluated as the most excellent in glossiness was ranked as A, and subsequently evaluated electrophotographic prints were respectively ranked as B, C, D, or E.

[Evaluation Criteria]

A: Very excellent (effectively utilizable as a high-quality image recording material)

B: Excellent (effectively utilizable as a high-quality image recording material)

C: Passable

D: Degraded (Not utilizable as a high-quality image recording material)

E: Considerably degraded (Not utilizable as a high-quality image recording material)

TABLE 4

| | Support | Image quality | Glossiness |
|---|---|---|---|
| Ex. 9 | Ex. 1 | A | A |
| Ex. 10 | Ex. 2 | A | A |
| Ex. 11 | Ex. 3 | A | A |
| Ex. 12 | Ex. 4 | A | A |
| Ex. 13 | Ex. 5 | B | B |
| Ex. 14 | Ex. 6 | A | A |
| Ex. 15 | Ex. 7 | A | A |
| Ex. 16 | Ex. 8 | B | A |
| Compara. Ex. 6 | Compara. Ex. 1 | D | C |
| Compara. Ex. 7 | Compara. Ex. 2 | E | D |
| Compara. Ex. 8 | Compara. Ex. 3 | C | C |
| Compara. Ex. 9 | Compara. Ex. 4 | D | C |
| Compara. Ex. 10 | Compara. Ex. 5 | C | B |

The evaluation results shown in Table 4 demonstrated that the electrophotographic materials of Examples 9 to 16 which were produced using the image recording material supports of Examples 1 to 8 allowed for forming an image which was excellent in both image quality and glossiness as compared to the electrophotographic materials of Comparative Examples 6 to 10 which were produced using the image recording material supports of Comparative Examples 1 to 5.

Since the image recording material support of the present invention allows obtaining an image print having high-image quality and high-glossiness because it is excellent in planality and glossiness and has steady rigidity, and the image recording material can be preferably used for image printing application such as for full-color images and photographic images, and in particular, can be preferably used as an electrophotographic material, a heat-sensitive material, a sublimation transfer material, a heat transfer material, a silver salt photographic material, or an inkjet recording material.

What is claimed is:

1. An image recording material support comprising:

a paper wherein the paper comprises at least a pulp wherein the average fiber length of the pulp is 0.6 mm to 0.7 mm; and the content ratio of long fiber pulp having a fiber length of 0.7 mm or more in the paper relative to the entire pulp content is 18% or less.

2. The image recording material support according to claim 1, wherein the content ratio of long fiber pulp having a fiber length of 0.7 mm or more relative to the entire pulp content is 15% or less.

3. The image recording material support according to claim 1, wherein the pulp is beaten using a refiner equipped with beating plates having an average blade angle of 10 degrees or less.

4. The image recording material according to claim 1, wherein the paper comprises a polymer coat layer on both surfaces thereof.

5. A method for producing an image recording material support comprising:

beating a pulp using a refiner equipped with beating plates having an average blade angle of 10 degrees or less to thereby produce an image recording material support, wherein the image recording material support comprises a paper containing at least a pulp wherein the average fiber length of the pulp is 0.6 mm to 0.7 mm; and the content ratio of long fiber pulp having a fiber length of 0.7 mm or more in the paper relative to the entire pulp content is 18% or less.

6. The method for producing an image recording material support according to claim 5, wherein the pulp is beaten while positively rotating and reversely rotating the beating plate alternately at every 10,000,000 revolutions.

7. The method for producing an image recording material support according to claim 5, wherein the pulp is beaten so as to have a freeness of 200 mL to 400 mL.

8. The method for producing an image recording material support according to claim 5, wherein the paper comprises a polymer coat layer on both surfaces thereof.

9. An image recording material comprising:

an image recording material support, and an image recording layer, wherein the image recording material support comprises paper containing at least a pulp wherein the average fiber length of the pulp is 0.6 mm to 0.7 mm; the content ratio of long fiber pulp having a fiber length of 0.7 mm or more in the paper relative to the entire pulp content is 18% or less; and the image recording layer having an image to be recorded thereon.

10. The image recording material according to claim 9 selected from any one of electrophotographic materials, heat-sensitive materials, sublimation transfer materials, heat transfer materials, silver salt photographic materials, and inkjet recording materials.

11. The image recording material according to claim 10, wherein the image recording material is an electrophotographic material which comprises a support, and at least one toner image-receiving layer formed on the support.

12. The image recording material according to claim 9, wherein the paper comprises a polymer coat layer on both surfaces thereof.

* * * * *